United States Patent [19]

Watanabe et al.

[11] Patent Number: 4,884,909

[45] Date of Patent: Dec. 5, 1989

[54] RECORDING APPARATUS

[75] Inventors: Yoshitaka Watanabe, Tokyo; Yoshiyuki Mizoguchi, Yokohama; Hiroyuki Hiraga, Tokyo, all of Japan

[73] Assignee: Canon Kabushiki Kaisha, Tokyo, Japan

[21] Appl. No.: 136,370

[22] Filed: Dec. 22, 1987

[30] Foreign Application Priority Data

Dec. 25, 1986 [JP] Japan ..... 61-307905
Dec. 25, 1986 [JP] Japan ..... 61-307906

[51] Int. Cl.[4] ..... B41J 11/58; B41J 13/10

[52] U.S. Cl. ..... 400/625; 271/273; 271/274; 271/314; 400/187; 400/629

[58] Field of Search ..... 400/185, 187, 624, 625, 400/629; 271/3, 4, 273, 273, 114, 116, 314

[56] References Cited

U.S. PATENT DOCUMENTS

| | | | |
|---|---|---|---|
| 4,089,402 | 5/1978 | Hyland | 400/625 |
| 4,212,456 | 7/1980 | Ruenzi | 400/629 X |
| 4,268,021 | 5/1981 | Rutishauser | 400/629 X |
| 4,275,969 | 6/1981 | Matsuhisa | 400/629 X |
| 4,431,323 | 2/1984 | Kulow | 400/625 |
| 4,527,172 | 7/1985 | Nagashima | 400/629 X |
| 4,560,990 | 12/1985 | Sue | 400/621 X |
| 4,581,618 | 4/1986 | Watanabe | 400/625 X |
| 4,649,437 | 3/1987 | Watanabe | 400/120 X |
| 4,698,650 | 10/1987 | Watanabe et al. | 346/134 |
| 4,699,366 | 10/1987 | Kashimura et al. | 271/4 |
| 4,747,707 | 5/1988 | Komori | 400/120 X |
| 4,828,416 | 5/1989 | Pensavecchia | 400/624 |

FOREIGN PATENT DOCUMENTS

| | | | |
|---|---|---|---|
| 31985 | 2/1985 | Japan | 400/629 |

*Primary Examiner*—P. T. Sewell

*Attorney, Agent, or Firm*—Fitzpatrick, Cella, Harper & Scinto

[57] ABSTRACT

A low cost, compact ink jet recording apparatus effectively uses a single drive source for controlling paper feed and discharge operations. The apparatus comprises a feed mechanism for feeding a sheet to be printed, discharge rollers for discharging the printed sheet, a moving mechanism for engaging and disengaging the discharge rollers, and a single drive source for operating the feed mechanism, the discharge rollers and the moving mechanism. The apparatus increases sheet feeding reliability by disengaging the discharge rollers during printing. Because the sheet feed mechanism, moving mechanism and discharge rollers are operated by a single drive source, a simpler structure is possible.

5 Claims, 16 Drawing Sheets

RECORDING APPARATUS

BACKGROUND OF THE INVENTION

1. Field of the Invention

The present invention relates to a recording apparatus and, more particularly, to a recording apparatus comprising an automatic discharge mechanism after a printing operation.

2. Prior Art

In a conventional apparatus of this type, a sheet is conveyed through processes, i.e., paper feeding from a hopper, a printing operation in a printing section, and paper discharge after the printing operation. In consideration of a simple and compact apparatus, a path along which the sheet is conveyed must be simple and short.

In a previously proposed apparatus, a print mechanism and a paper discharge mechanism are arranged adjacent to each other, and are driven by a single drive source. During the printing operation, a paper discharge roller of the paper discharge mechanism is escaped or disengaged from a paper guide portion so as not to load or interface with the feeding of a printing sheet. During the paper discharge operation, the paper discharge roller is moved in the paper guide portion to discharge a sheet.

However, the paper feed and paper discharge operations have no continuous and intimate relationships therebetween. Therefore, if the paper discharge roller is driven by the paper feed motor as described above, control operations for the paper feed and paper discharge operations are rather complicated, resulting in functional limitations. In order to effectively transmit power of the paper feed motor, the paper feed roller (paper feed portion) and the paper discharge roller (paper discharge portion) must be arranged adjacent to each other, resulting in structural limitations.

In view of compact and lost-cost apparatus,.the print mechanism of the apparatus can employ frictional feed using a platen. In this case, the platen is driven by a pulse motor. In this case, in order to assure paper feed precision, a friction mechanism for attenuating motor vibration must be interposed between the platen and the pulse motor. Therefore, in the conventional apparatus, the pulse motor is used for only driving the platen through the friction mechanism. For this reason, the paper discharge mechanism is driven by another motor. As a result, the paper discharge mechanism is separated from the platen, and an additional convey mechanism must be arranged therebetween, resulting in a large, expensive, and complicated apparatus.

SUMMARY OF THE INVENTION

It is an object of the present invention to provide a recording apparatus which is free from the conventional drawbacks, and has no functional and structural limitations and comprises a compact and low-cost mechanical portion.

It is another object of the present invention to provide a recording apparatus which effectively utilizes one drive source.

DETAILED DESCRIPTION OF THE PREFERRED EMBODIMENTS

A printer apparatus according to an embodiment of the present invention will be described in detail with reference to the accompanying drawings.

Outer Appearance

Figure 1:
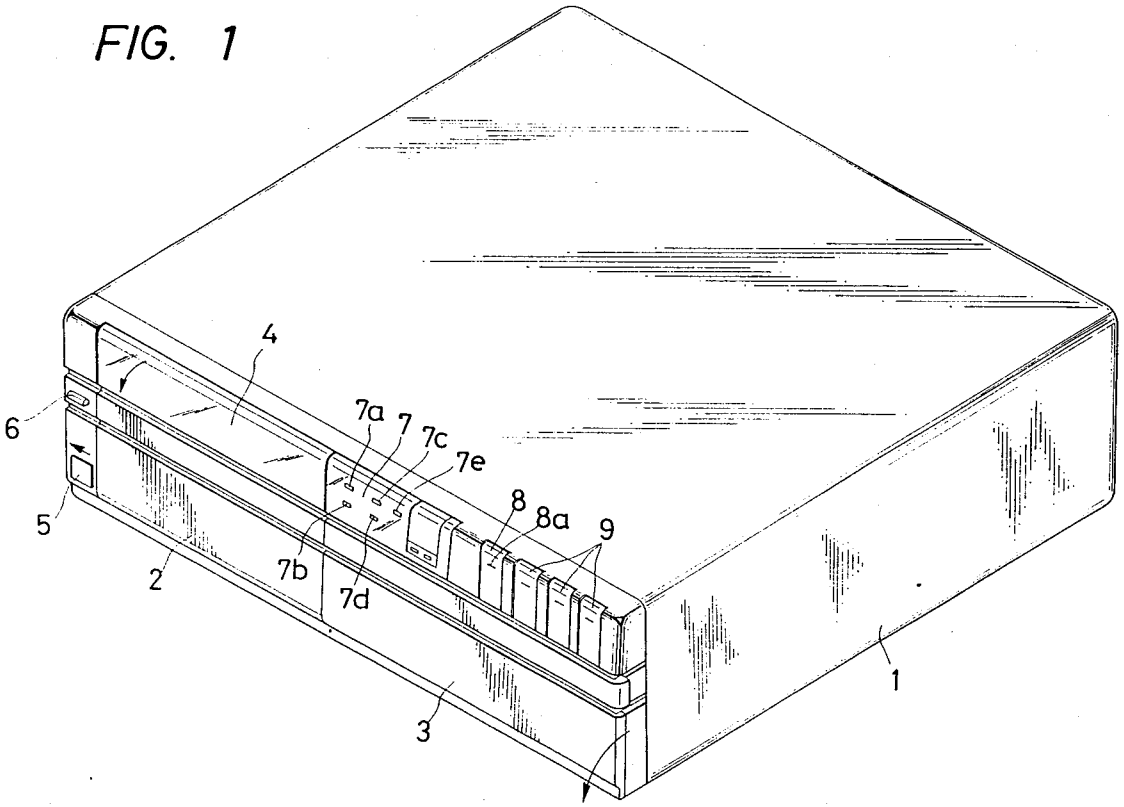
FIG. 1 is a perspective view showing an outer appearance of a printer apparatus.
Figure 2:
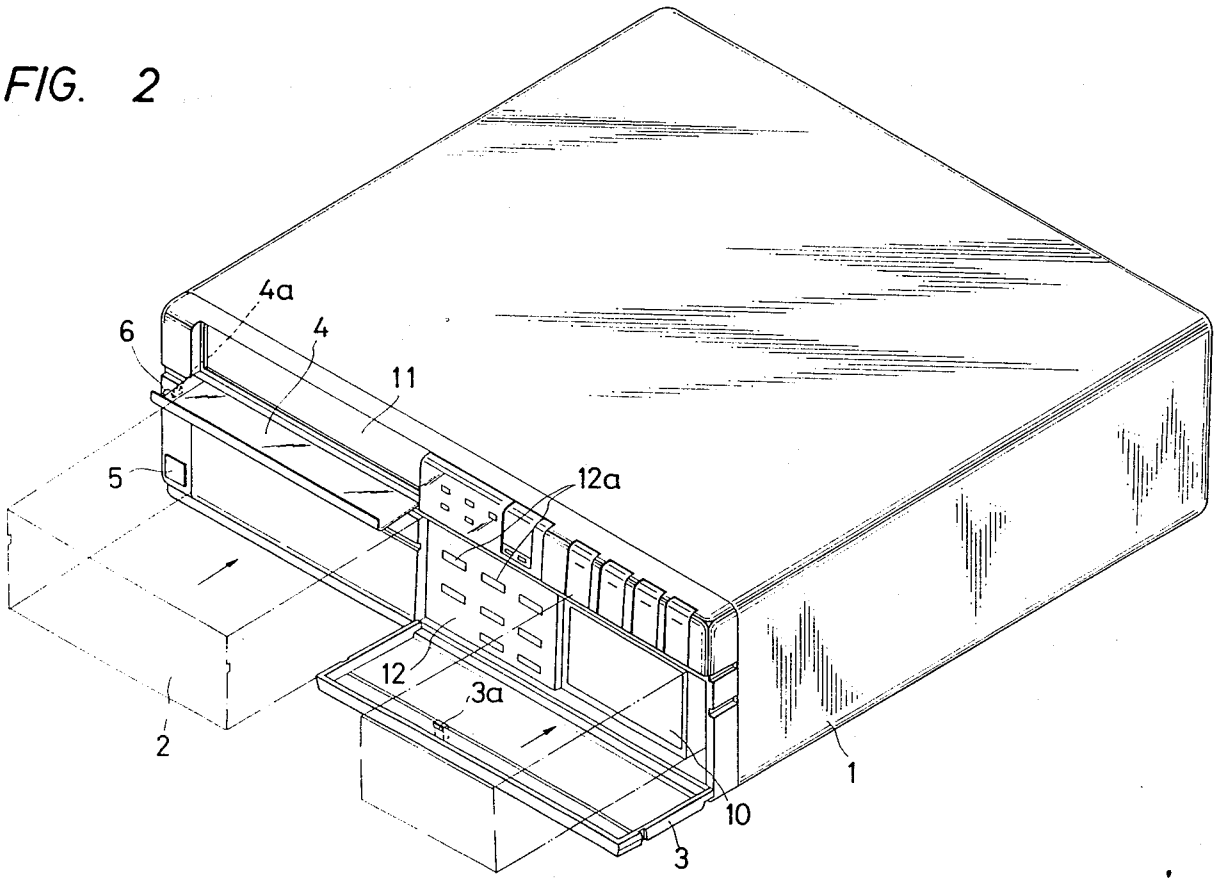
FIG. 2 is a perspective view showing the printer apparatus shown in FIG. 1 in a state wherein a dressing lid and a dust cover are open.

FIGS. 1 and 2 show the outer appearance of a printer body 1 of the printer apparatus. A small-sized cassette 2 is detachably loaded into a front surface of the printer body 1. A dressing lid 3 is pivotally mounted on the front surface of the printer body 1 adjacent to the right side of the cassette 2. In an open state of the dressing lid 3, as shown in FIG. 2, an ink cartridge 10, a sub-operation switch unit 12, and the like are exposed. The dressing lid 3 is locked in a closed state by a pawl **3*a* thereof, and a notch portion (not shown) formed in the printer body 1. When the dressing lid 3 is lightly pushed in a direction indicated by an arrow in FIG. 1, the lock is disengaged, and an open state shown in FIG. 2** is obtained.

A dust cover 4 for a paper feed port 111 is pivotally mounted on the front surface of the printer body 1 adjacent to and above the cassette 2. The dust cover 4 has a pawl **4*a***, and can be opened/closed in the same manner as in the dressing lid 3. A dust cover switch SW1 (to be described later) is attached to the dust cover 4, thus detecting an open/closed state of the dust cover 4.

A knob 5 for loading/unloading the cassette 2 is disposed adjacent to the left side of the cassette 2. The knob 5 will be described later in detail. A power switch 6 is disposed above the knob 5.

An indicator unit 7 is arranged above the left side of the dressing lid 3. The indicator unit 7 has an indicator 7a for indicating an abnormality of a paper feed system, an indicator 7b for indicating an abnormality of an ink supply system, an indicator 7c for indicating a printing position A, an indicator 7d for indicating a printing position B, and an indicator 7e for indicating a printing position C, all of which are covered by a dust cover 7f.

Main operation switches 8 and 9 are disposed above the right side of the dressing lid 3. The main operation switch 8 serves as a printer switch, and is provided with an LED 8a indicating that a printing switch is operated. The main operation switch 9 is not related to the present invention, and a detailed description thereof will be omitted.

The ink cartridge 10 is pushed in a direction indicated by an arrow, and is then coupled to an ink-jet head IJU through a known needle. The ink cartridge 10 can be detached by a lever to be described later. As shown in FIG. 2, the sub-operation switch unit 12 comprises a switch 12a for selecting the printing position, and other switches of the unit 12 are not related to the present invention and a detailed description thereof will be omitted.

Internal Layout

Figure 3:
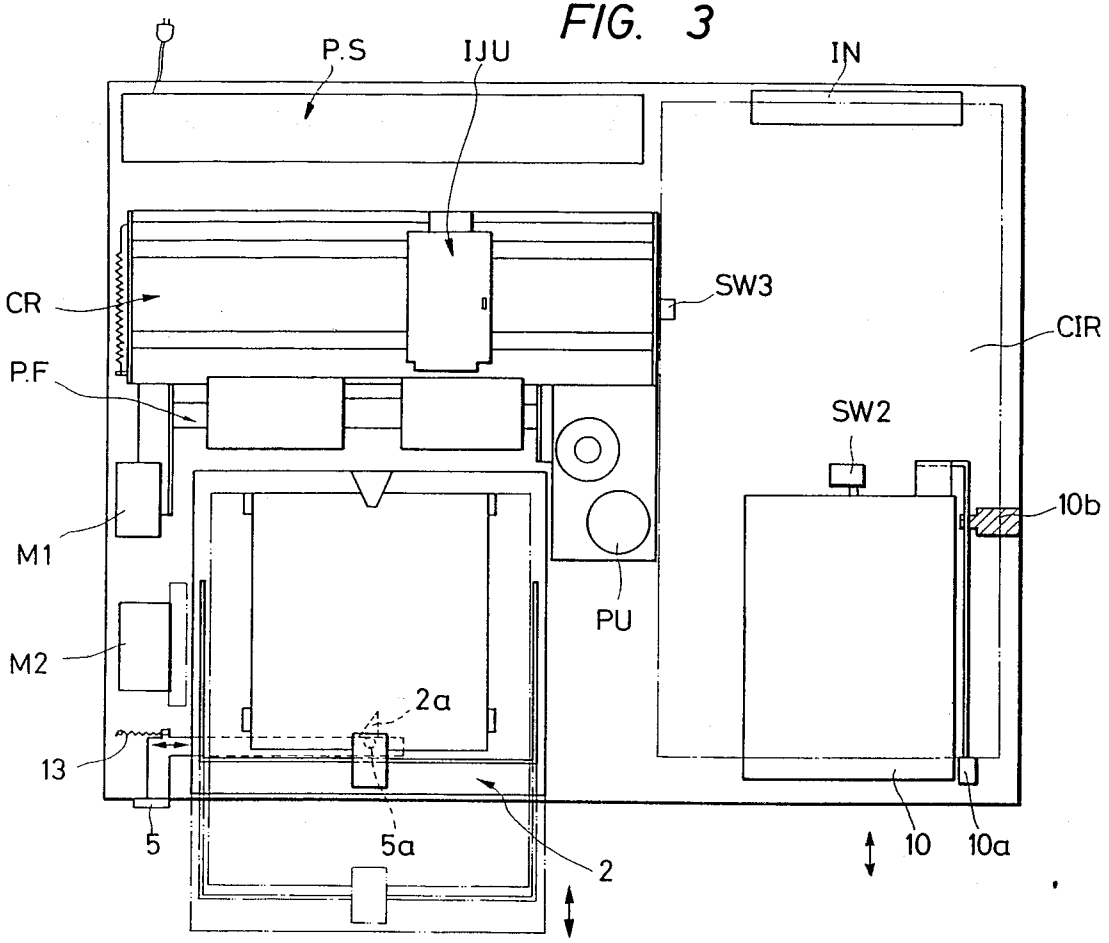
FIG. 3 is a plan view schematically showing an internal structure of the printer apparatus.

FIG. 3 is a plan view schematically showing an internal arrangement of the printer body 1, and illustrates the principal layout.

A carriage system CR (to be described later) is disposed in an inner left portion of the printer body 1. The ink-jet head IJU is main-scanned by the carriage system CR. A paper feed system PF is disposed in front of the carriage system CR. The paper feed system PF comprises a platen roller 22, paper feed rollers 18, a paper feed motor M2, a paper feed motor M1, and the like, and will be described later in detail.

A pump system PU is disposed at the central portion in the printer body 1. The pump system PU is comprises by a negative pressure generating mechanism, a valve mechanism, a cap 104, and the like. As can be seen from FIGS. 2 and 3, the ink cartridge 10 is held on the right side in the printer body 1 and at the same level as the lower surface of the body 1, and to be lower than the ink-jet head IJU, so that the distal end of the ink-jet head IJU is maintained at a negative pressure so as to prevent ink leakage from the distal end of the ink-jet head IJU.

A lever 10a is pivotally arranged about a pivot 10b fixed to the printer body 1. When the lever 10a is operated, the ink cartridge 10 can be detached (exchanged). A switch SW2 for detecting the presence/absence of the ink cartridge 10 is disposed behind the ink cartridge 10.

An electrical circuit CIR fixed to the printer body 1 by a known means is arranged above the ink cartridge 10. The electrical circuit CIR is connected to an input terminal IN exposed on the rear right side of the printer body 1. A power supply PS is disposed on the rear left side of the printer body 1.

Since the power supply system is arranged as described above, a substrate design can be simplified, and an influence caused by heat generated by the circuit to the ink cartridge 10 and the ink-jet head IJU can be minimized. Since the mechanical system and the electrical system are separately disposed, assembly and maintenance are facilitated.

The knob 5 for loading/unloading the cassette 2 is formed to have a substantially L shape, and is mounted to be partially exposed at the front surface of the printer body 1. The knob 5 is biased inwardly by a spring 13, and can be slid along a direction indicated by an arrow by a guide pin (not shown). A pin 5a projects upward from the distal end portion of the knob 5 extending to the lower central portion of the cassette 2. A triangular cam 2a is fixed to the central portion of the lower surface of the cassette 2 to be locked by the pin 5a. The cam 2a and the pin 5a constitute a lock mechanism for the cassette 2. Note that an alternate long and two short dashed line in FIG. 3 indicates a cassette mounting state.

Cassette

A structure of the cassette 2 for storing printing sheets P will be described with reference to FIGS. 4 to 8.

Figure 4:
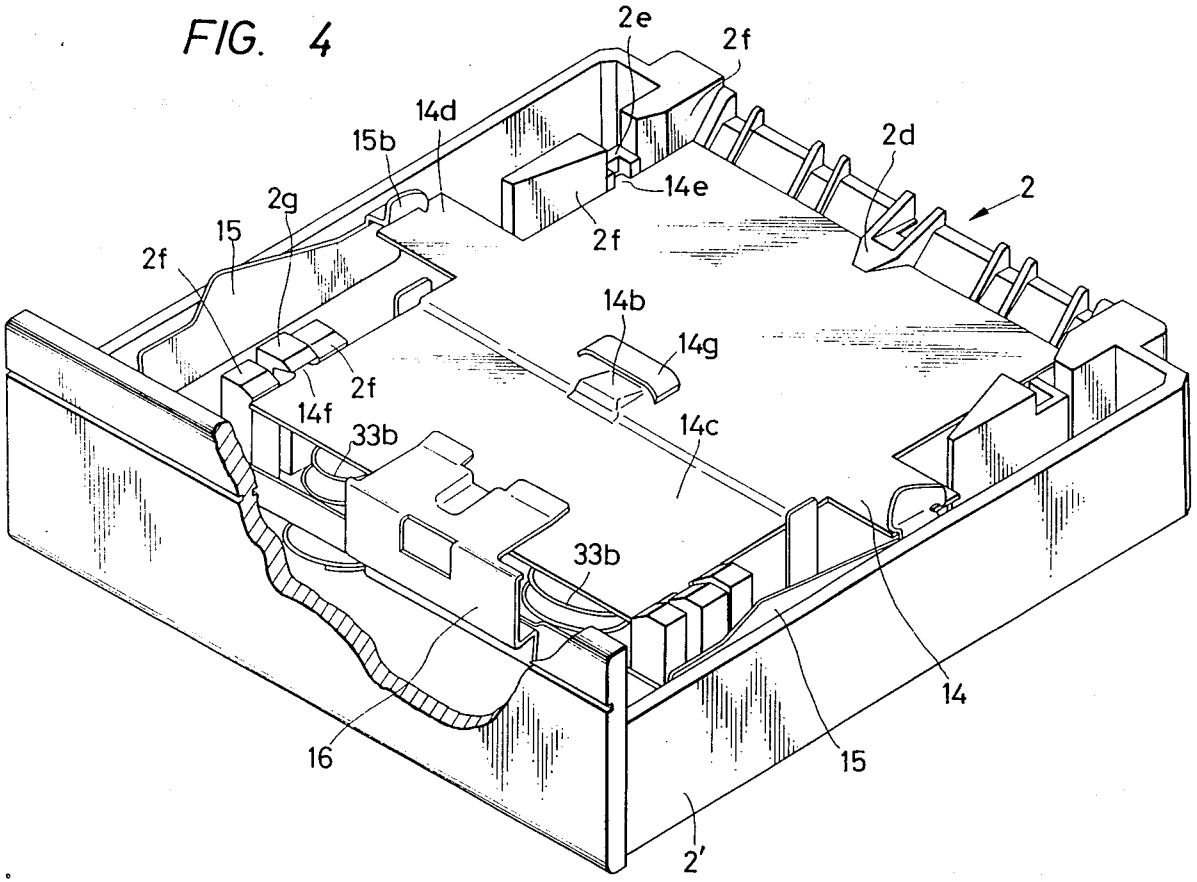
FIG. 4 is a partially cutaway perspective view showing a structure of a cassette.
Figure 8:
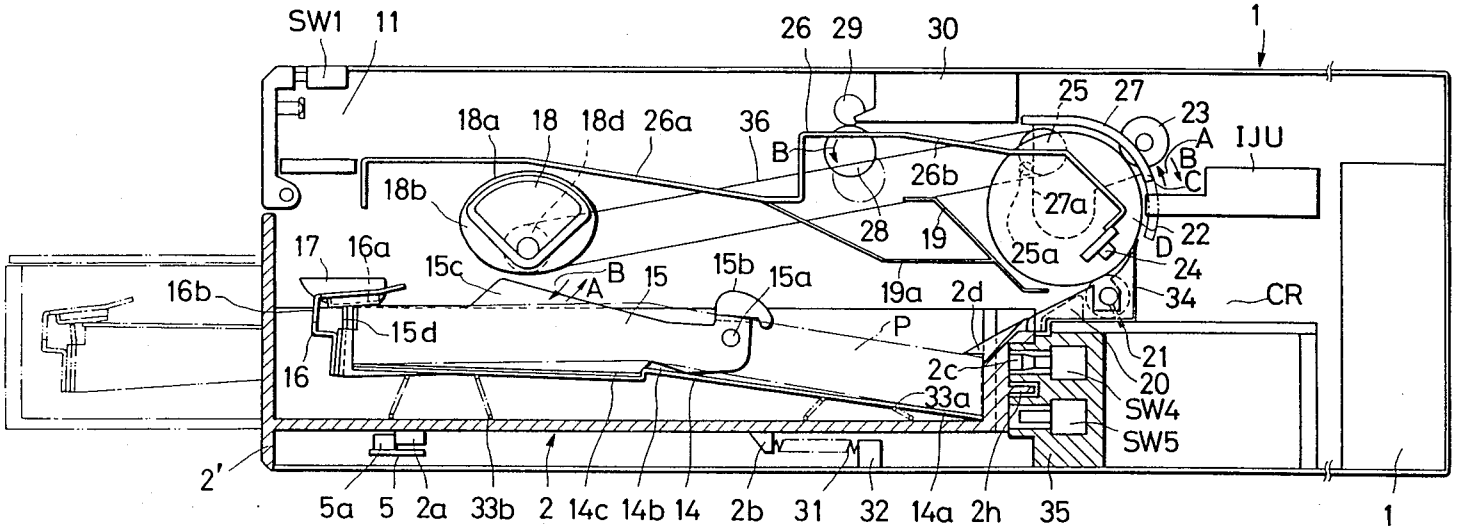
FIG. 8 is a side sectional view showing a structure of an interior of a printer body in which a cassette is inserted.

FIG. 4 is a partially cutaway perspective view of the small-sized cassette 2. The cassette 2 comprises a box-like cassette body 2' whose upper surface is open. The cassette body 2' has the cam 2a for locking the cassette on its lower surface, as shown in FIGS. 3 and 8. Furthermore, as shown in FIG. 8, the cassette body 2' is provided with a receiving portion 2b for receiving a spring 31 mounted on the lower surface of the printer body 1 through a mounting portion 32.

In this manner, the cassette 2 is subjected to a biasing force by the spring 31 toward an unloading direction. Therefore, when the locking cam 2a and the pin 5a are disengaged from each other to unlock and release, the cassette 2 can be automatically unloaded forward by the biasing force of the spring 31.

As shown in FIG. 8, two holes 2h are formed in the rear portion of the cassette body 2' and vertically aligned. A pin 2c is selectively disposed in the holes 2h. Projections are formed on a projecting portion 35 projecting from the bottom portion of the printer body 1 and are engaged with the holes 2h. Recesses in which the pin 2c is selectively inserted are formed in the end faces of the projections. Switches SW4 and SW5 which are operated by the pin 2c are respectively provided to the two recesses.

The small cassette 2 has the pin 2c corresponding to only the upper hole 2h, and selectively operates the switch SW4. A large cassette has the pin 2c corresponding to only the lower hole 2h, and selectively operates the switch SW5. Thus, the size or type of cassettes can be automatically detected.

In this embodiment, only two types of cassettes are described in detail. However, the present invention is not limited to this, and three or more cassettes can be discriminated. The reason why the pin 2c is to be inserted in the hole 2h is as follows. When the cassette 2 is removed from the printer body 1 and sheets P are stored therein, the pin 2c can be prevented from being broken or a hand of an operator can be prevented from being dirty. Furthermore, during paper jam, when the cassette 2 is removed and a jamming sheet is removed from the platen roller 22, the switches SW4 and SW5 can be prevented from being erroneously operated to cause an erroneous operation. Therefore, the switches SW4 and SW5 are arranged so as not to be touched by a hand or a finger.

As shown in FIG. 4, a sheet front press 2*d* is integrally formed in front of the cassette body 2' and at the central portion in the widthwise direction of the sheet P. The front press 2*d* has a triangular section, its lower surface is substantially horizontally arranged, and its inclined surface is tilted upward and forward. In this front press 2*d*, when the sheet P pressed by the front press 2*d* is once pulled backward and is then fed forward, the sheet P is not caught by the front press 2*d* and is lifted upward along the inclined surface.

The reason why the front press 2*d* is arranged on only the center of the widthwise direction of the sheet P is that the following advantages can be obtained as compared with a case wherein it is arranged on a front surface or two end portions:

1 A load upon separation is small.
2. Upon separation, since a sheet can be kept flat at three points, i.e., the two paper feed rollers 18 and the front press 2*d*, the sheet P can be stably separated.
3. When a sheet is fed toward the platen roller 22, the front press 2d is located at the center and is locally present, so that the sheet can hardly be caught thereby even if the sheet is curled.

Note that the front press 2*d* is integrally formed on the cassette body 2' in this embodiment. However, the present invention is not limited to this. For example, the front press 2*d* may be vertically movably mounted on the cassette body 2' to abut against the uppermost sheet by its own weight. The front press 2*d* may also be pivotally arranged.

An inner plate 14 is stored in the cassette body 2' to be vertically movable. Guides 2*e* for guiding the inner plate 14 in a longitudinal direction thereof are arranged at the front side portions of the cassette body 2'. A guide projection 14*e* projecting from the side front edge portion of the inner plate 14 is inserted and guided in each guide 2*e*. Side guides 2*f* for the sheet P are disposed on the two side front portions of the cassette body 2'. Regulating portions 2*g* for regulating upward movement of the inner plate 14 are formed on the two side rear portions of the cassette body 2'. The regulating portions 2*g* are arranged to press projections 14*f* projecting from the side rear edges of the inner plate 14. In the cassette body 2', the upward movement of the inner plate 14 is regulated by the regulating portions 2*g* and the front press 2*d*. Note that the two guides 2*e*, the side guides 2*f*, and the regulating portions 2*g* are integrally formed on the cassette body 2'.

The inner plate 14 described above is constituted by an inclined surface 14*a* which is provided in a front half portion and is inclined downward and forward, a projection 14*b* provided at the center, a frictional member 14*c* which is in contact with the horizontal surface formed in a rear half portion, a soft sheet 14*g* covering the projection 14*b*, guide portions 14*e* and 14*f* for respectively engaging with the guides 2*e* and the side guides 2*g* of the cassette body 2', and contact portions 14*d* contacting separation levers 15 (to be described later). Front and Rear portions of the inner plate 14 are biased upward by coil springs 33*a* and 33*b*, respectively.

Each separation lever 15 has a substantially U-shape. The proximal end portions of the separation levers 15 extend along the rear edges of the cassette body 2', and their end portions extend to portions near the central portions of the side edges of the cassette body 2'. Cam portions 15*b* and 15*c* are formed on the end portions of each lever 15, respectively. Each separation lever 15 is pivotally supported about a pivot 15*a* arranged near the central portion in the longitudinal direction of the cassette body 2'.

Note that the separation levers 15 need not be pivotally supported. For example, the levers 15 may be pivotally mounted on the cassette body 2'. That is, the separation levers 15 need only be pivotally supported.

A separation portion 15*d* is provided near the central portion of the proximal end portion of each separation lever 15. A separation plate 16 is fixed to the proximal end portion of each separation lever 15 having the separation portion 15*d*. Each separation plate 16 comprises a separation portion 16*a* having a projection projecting downward and a paper regulating portion 16*b*.

Figure 7B:
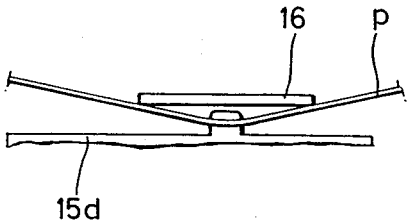
FIGS. 7A and 7B are front views respectively showing a shape of the separation plate and its modification.
Figure 7A:
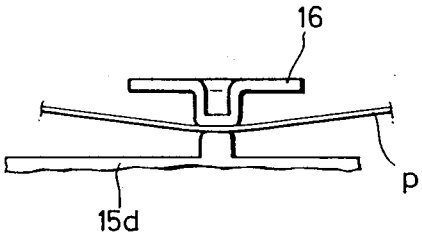

The reason why the separation portion 16*a* of the separation plate 16 has the downward projection as shown in FIG. 7A is to decrease a contact resistance against a sheet and to cope with a curled sheet. That is, if the separation portion 16*a* is formed flat, as shown in FIG. 7B, a sheet cannot enter the separation portion due to the influence of the two ends of a flat plate. However, if the separation portion has a projection, the sheet can easily enter a gap defined between the separation portions 15*d* and 16*a* and can be separated. A gap t between the separation portions 15*d* and 16*a* is determined to have the following relation:

$$t_1 < t < 2t_1$$

where $t_1$ is the thickness of the sheet P.

Figure 6B:
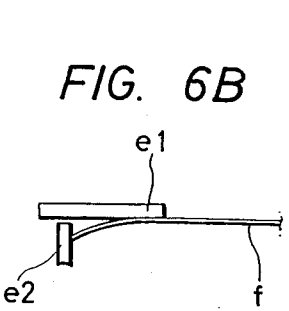
FIG. 6B is a side sectional view showing a conventional state wherein a sheet which is curled downward is not separated from the horizontal separation plate.
Figure 6A:
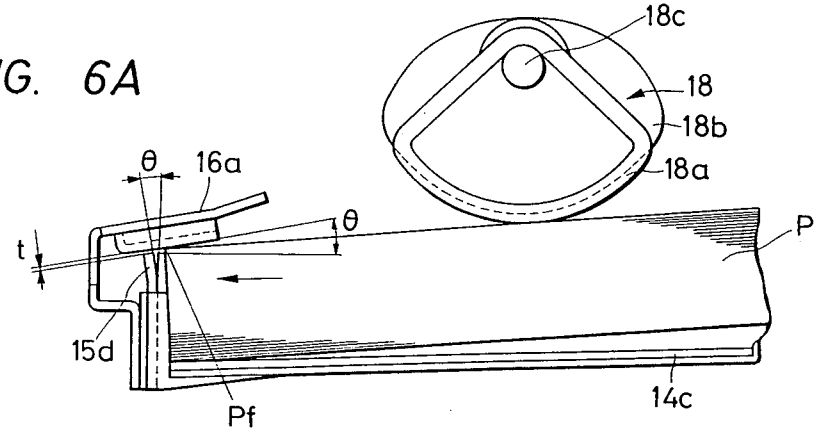
FIG. 6A is a side sectional view showing a mounting state of a separation section and a separation plate.

Each separation portion 16*a* is inclined at an angle $\theta$ with respect to the backward direction of the sheet, as shown in FIG. 6A. Even if the sheet is curled downward, as shown in FIG. 6B, the separation portion 16*a* is not influenced by the curled sheet. In this manner, any curled sheet can satisfactorily enter a gap t using the inclined surface of the separation portion 16*a* as a guide.

Note that the frictional member 14*c* of the inner plate 14 is arranged to feed the lowermost sheet in the cassette body 2', and has the same effect as a known separation method (ex. pawl separation). The frictional member 14*c* is set to have a frictional coefficient substantially equal to or larger than that of a sheet, and is formed of, e.g., suede or cork.

The sheet 14*g* of the inner plate 14 is arranged to protect a paper printing section. More specifically, the sheet P is inserted in the cassette body 2' while its printing surface faces down, and hence, the last sheet, i.e., the lowermost sheet receives a concentrated bending load by the projection 14*b* and is locally deformed. Due to such local deformation, delicate miscoloring or damage may locally occur. In order to prevent this, the sheet 14*g* (e.g., a fabric such as suede) is adhered so that the load is not concentrated but distributed.

Assume that the projection 14*b* of the inner plate 14 is arranged to extend throughout the overall width of the plate 14. When a sheet is pushed by the pair of paper feed rollers 18, if a sheet is curled, the effect of the projection 14*b* is impaired due to a large thickness of the sheet. For this reason, the projection 14*b* is locally provided at the center of the inner plate 14, and is pressed downward by the pair of paper feed rollers 18, so that the curling in the longitudinal direction is forcibly formed and the distal end portion of the sheet is effectively floated by utilizing the rigidity of the longitudinal curl. This fact has already been experimentally demonstrated.

Figure 5:
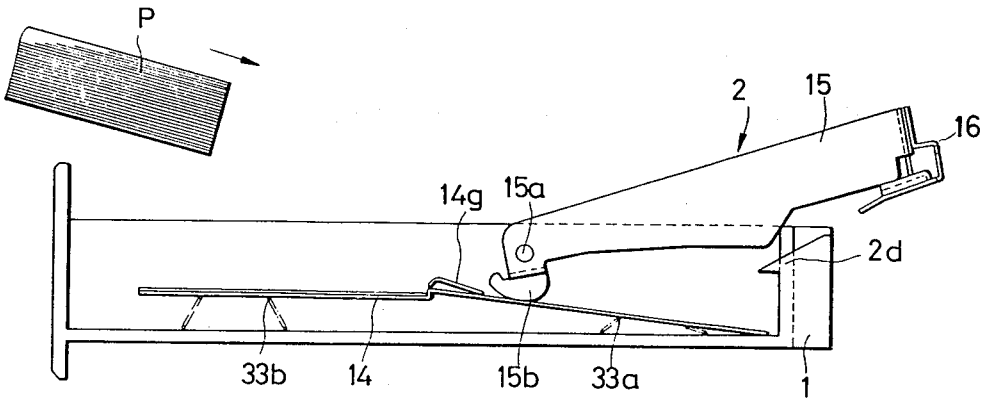
FIG. 5 is a side sectional view showing a state wherein a separation lever is pivoted to allow a bundle of sheets to be mounted.

The cam portions 15b and 15c are formed into shapes so as to press downward the inner plate 14 contacting the cam portions 15b and 15c against, the biasing forces of the coil springs 33a and 33b when the separation levers 15 are pivoted during loading of the sheets P, as shown in FIG. 5. In this manner, when the inner plate 14 is pressed downward upon operation of the cam portions 15b and 15c during loading of the sheets P, the distal end portion of the inner plate 14 is largely separated downward from the front press 2d of the cassette body 2', as shown in FIG. 5. As a result, the distal end portion of the bundle of sheets the front press 2d and the distal end portion of the inner plate 14.

When the separation levers 15 are pivoted and returned to home positions while the bundle of sheets P are loaded on the inner plate 14, the cam portions 15b and 15c of the levers 15 can no longer press the inner plate 14, and hence are lifted upward by the biasing forces of the coil springs 33a and 33b. In this manner, the distal end portion of the bundle of the sheets P is elastically urged against the lower surface of the front press 2d.

For a large-sized cassette, it can be considered that the separation portions 15d and 15e and the separation plates 16 are shifted backward and a width is increased. Substantially the same operation as above is performed, and a detailed description thereof will be omitted. However, as can be seen from FIG. 3, the U-shaped portions of the separation levers 15 of the small- and large-sized cassettes have the same width, and these cassettes also have the same width.

Cassette Loading Section

As has been described above with reference to FIGS. 2, 3, and 8, the printer body 1 has the knob 5 for locking the cassette 2 in a loading state, and the spring 31 for biasing the cassette 2 in the unloading direction.

As shown in FIG. 8, the projecting portion 35 described above is provided for the back-and-forth direction of the cassette 2, and guides 17 are provided for the vertical direction thereof. The guides 17 are engaged with the projections 15c formed on the separation levers 15 during loading of the cassette 2 so as to temporarily forcibly pivot the separation levers 15 downward. In this manner, a bending load is applied to the sheets P loaded in the cassette 2 about the front press 2d of the cassette body 2' and the projection 14b of the inner plate 14 upon loading of the cassette 2, thereby laterally curling the sheets to correct longitudinal curl (that is, sheets are normally curled longitudinally with respect to a feed direction).

When the cassette 2 which is loaded in the printer body 1 is unloaded, the knob 5 is slid in the lateral direction to release the lock, so that the cassette 2 is popped forward by the biasing force of the spring 31. During this unloading operation, the guides 17 abut against the cam portions 15b and 15c of the separation levers 15. Thus, unloading of the cassette 2 is stopped at an appropriate position at which the cassette 2 is partially popped from the printer body 1, thus preventing an accident, e.g., dropping of the cassette 2.

Paper Feed System PF

The paper feed system PF will be described with reference to FIGS. 8 and 9.

The paper feed system PF comprises the paper feed rollers 18 engaged with the uppermost sheet of the loaded sheets P to feed the sheet. Each paper feed roller 18 is formed into a semilunar shape to facilitate loading-/unloading of the cassette 2. The rollers 18 are integrally constituted by rubber roller bodies 18a which are disposed to be separated from each other along a shaft, a shaft 18c on which the roller bodies 18a are coaxially fixed, a pulley 18d coaxially fixed at a front end of the shaft 18c, and a gear 18e which is coaxially fixed adjacent to the pulley 18d and has a pin 18f on its outer periphery.

The two edge portions of the feed rollers 18 have cam portions 18b formed of a resin having a relatively small frictional force. A rubber member as a high-frictional member is adhered to the circumferential surface of each roller body 18a.

The above-mentioned shaft 18c is rotatably arranged on a base plate (not shown) of the printer body 1 through a bearing and the like, and is coupled to the pulse motor M2 as the paper feed motor. The pulley 18d is coupled, through a belt 36, to a pulley 25 having a pin 25a on its outer periphery to perform 1:1 rotation. The pulley 25 is supported on the base plate (not shown) so as to be located above and adjacent to the platen roller 22 (to be described later). Note that the pin 25a is arranged to engage with a cam portion 27b of a movable paper guide 27 (to be described later).

A switch SW6 is disposed outside the gear 18e. The switch SW6 is operated by the pin 18f of the gear 18e, and hence serves as a switch for detecting an initial position of the paper feed rollers 18.

As shown in FIG. 8, paper guides 19 and 20 are fixed in the printer body 1. One paper guide 19 is arranged so that its distal end portion extends below the platen roller 22 (to be described later). The paper guide 19 is arranged to prevent a fed sheet from contacting the outer periphery of the platen roller 22 formed of rubber so that it cannot reach a rolling contact portion between the platen roller 22 and the register rollers 21, thus preventing skew. The register roller 21 are in rolling contact with the platen roller and serve as idler rollers.

More specifically, the paper guide 19 comprises a flat portion 19a which extends substantially horizontally to be located in front of the distal end portion. The flat portion 19a serves to press the sheet P from the above so as to prevent an excessive loop of the sheet P during its feeding (to be described later). With this arrangement, when a sheet is excessively looped after the leading end of the sheet abuts against the rolling contact portion between the register rollers 21 and the platen roller 22, the leading end portion Pf of the sheet can be prevented from being returned and separated from the rolling contact portion between the register rollers 21 and the platen roller 22. In addition, since the loop is pressed from the above, a convey force (propelling force) is generated by a spring force of the sheet. In particular, in order to assure a wide printing range like in this embodiment, even when the register rollers 21 are located in a rear portion, the leading end Pf of the sheet can reliably reach the rolling contact portion between the rollers 21 and 22.

The platen roller 22 is arranged to feed a sheet fed by the paper feed rollers 18 to a printing section. The platen roller 22 is constituted by inserting a rubber roller on a shaft 22a under pressure. The register rollers 21 are disposed to be urged on press against the peripheral surface of the lower rear half portion of the platen roller 22, and pinch rollers 23 are urged against the outer peripheral surface of the upper rear half portion of the platen roller 22. Note that the register rollers 21 and the pinch rollers 23 are biased by a spring (not shown) and urged against each other.

The sheet P is fed upon rotation of the platen roller 22 in a state wherein it is clamped between the register rollers 21, the pinch rollers 23, and the platen roller 22. A gap between the register rollers 21 and the pinch rollers 23 defines an effective range of a printing operation, in other words, a printing range. That is, if the upper end of a sheet is not engaged with the pinch rollers 23, a satisfactory printing result cannot be obtained, and if the lower end of a sheet is not engaged with the register rollers 21, a satisfactory printing result cannot be obtained.

For this reason, a gap between the register rollers 21 and the pinch rollers 23 is narrowed as small as possible within a range not to interrupt a printing operation by the ink-jet head IJU. In other words, as described above, in order to assure a wide printing range, the lower register rollers 21 are disposed to be located in a rearmost portion.

An annular recess is formed in the central peripheral surface, i.e., the central portion in a widthwise direction of the platen roller 22. A paper sensor 24 for detecting whether or not the sheet P is wound around the platen roller 22 is disposed in the recess. The paper sensor 24 comprises a reflection type photosensor, and is fixed to a guide plate 26 (to be described later) so as to maintain a predetermined position even when the platen roller 22 is rotated.

The paper sensor 24 is located to detect the leading edge of the sheet slightly projecting upward from the register rollers 21. Note that the paper sensor 24 is not limited to the reflection type photosensor but may be a transmission type photosensor or a mechanical switch such as a proximity switch or a limit switch. That is, any sensor may be adopted if it can detect the leading end of the sheet P.

The above-mentioned guide plate 26 is fixed to the base plate (not shown) of the printer body 1. The guide plate 26 comprises by a stacker portion 26*a* which is located above the paper feed rollers 18, temporarily stacking discharged sheets, a paper guide portion 26*b* for guiding a sheet subjected to the printing operation toward pairs of discharge rollers 28 and 29 (to be described later), and a mounting portion 26*c* for mounting the paper sensor 24.

A leaf spring 34 for pressing a sheet is disposed in contact with the outer peripheral surface between the lower register rollers 21 and the platen roller 22. The sheet passing the lower register rollers 21 can be reliably brought to or positioned in a gap between the platen roller 22 and the ink-jet head IJU by the leaf spring 34 without being separated from the outer peripheral surface of the platen roller 22.

A movable paper guide 27 is provided so that a fed sheet can be guided satisfactorily along the outer peripheral surface of the platen roller 22 between the ink-jet head IJU and the upper pinch rollers 23. The movable paper guide 27 is pivotally supported about the shaft 22*a* of the platen roller 22, and is biased counterclockwise by a coil spring 37, as indicated by an arrow A in FIG. 8. The position of the movable guide 27 is regulated by a paper guide 30 fixed to the printer body 1. The movable guide 27 can be driven by an operation of a cam against the force of coil spring 37 and reciprocal movement of the movable guide 27 can be smoothly performed.

The movable guide 27 further has a cam portion 27*b* contacting the pin 25*a* of the pulley 25. That is, upon rotation of the motor M2, the paper feed rollers 18 are rotated, and the pulley 25 is rotated through the belt 36. Along with such rotation, the paper guide 27 is reciprocated between points C and D around the platen roller 22.

Figure 9:
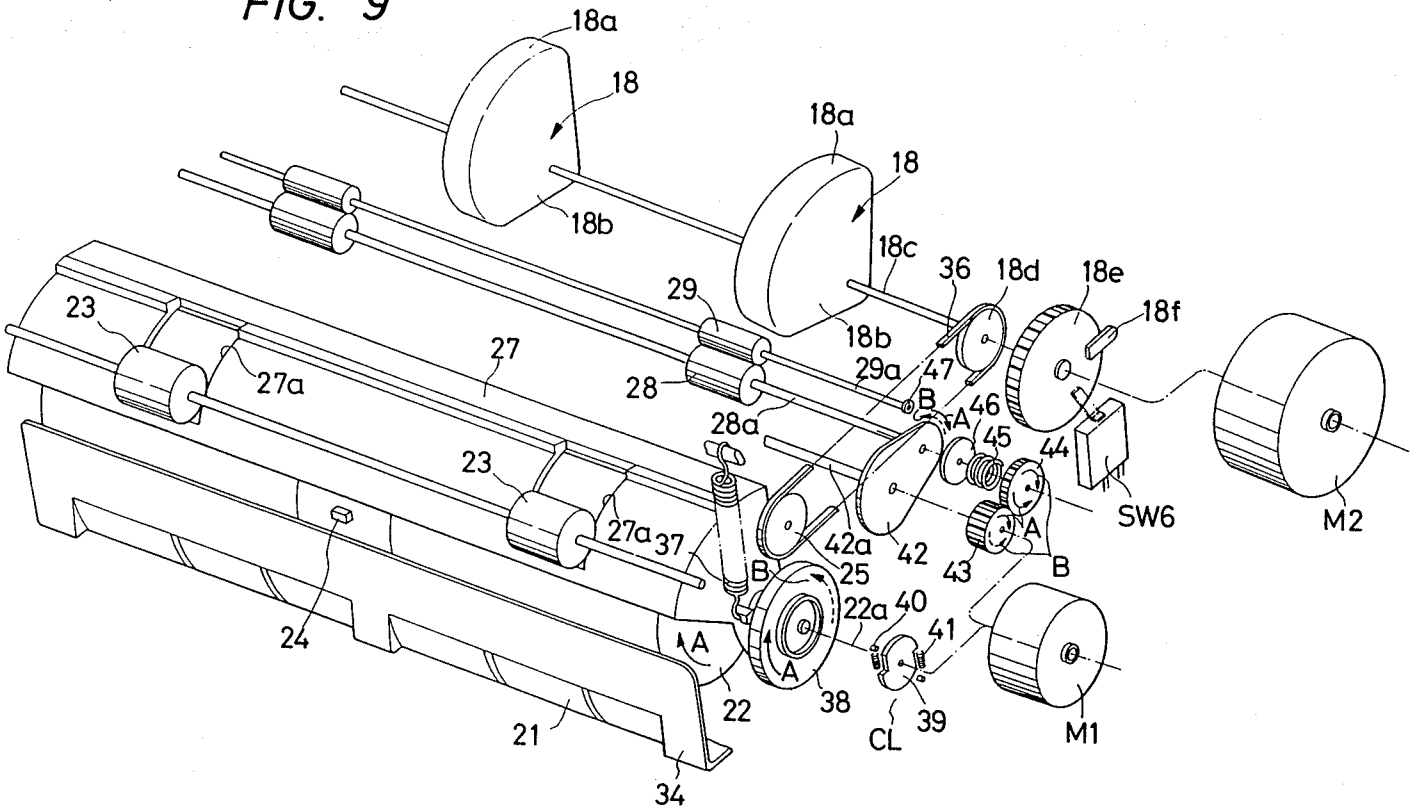
FIG. 9 is a perspective view showing a structure of a paper feed system.

Window portions 27*a* are formed on portions of the movable guide 27, corresponding to the upper pinch rollers 23, as shown in FIG. 9. The length in the circumferential direction of each window portion 27*a* is set to allow pivotal movement of the movable paper guide 27. As shown in FIG. 8, when the movable paper guide 27 is located at the position indicated by the point C, the pin 25*a* of the pulley 25 is not engaged with the cam portion 27*b* of the guide 27, and the guide 27 abuts against the paper guide 30 by the biasing force of the spring 37. In this state, the movable paper guide 27 is brought further upward, and opens a gap between the platen roller 22 and the ink-jet head IJU.

When the movable paper guide 27 is located at the position indicated by the point D in FIG. 8, the pin 25*a* of the pulley 25 is engaged with the guide 27, and the guide 27 can be pivoted upon pivotal movement of the pulley 25 against the biasing force of the spring 37. In this state, the movable paper guide 27 is pivoted downward, and closes the gap between the platen roller 22 and the ink-jet head IJU.

As shown in FIG. 9, a gear 38 is coaxially mounted on the front nd of the shaft 22*a* of the platen 22. The gear 38 causes a driving force of the pulse motor M1 (paper feed motor) to be coupled to the shaft 22*a* of the platen roller 22 through a known unidirectional clutch CL constituted by a cam 39, a pin 40, and a spring 41, so as to transmit only the driving force in one direction of the pulse motor M1 to the platen 22. Therefore, the rotating direction of the platen roller 22 is limited to a direction indicated by the arrow A in FIG. 9.

The discharge rollers 28 and 29 are disposed such that rolling contact portions therebetween are located along the convey path of the sheet P which is guided by the paper guide portion 26*b* of the guide plate 26. The upper discharge rollers 29 comprise plastic rollers, so as to not adversely influence the printed portion of a sheet subjected to printing. As shown in FIG. 9, the rollers 29 are arranged integrally with a shaft 29*a*, and are rotatably supported by a bearing 47 of the printer body 1. The lower discharge rollers 28 comprise rubber rollers, and are inserted on a shaft 28*a* under pressure. A gear 44 is mounted integrally with one end of the shaft 28*a* to be integrally rotated therewith.

A base plate 42 is disposed to rotatably support the shaft 28*a* at its distal end. The base plate 42 is rotatably mounted on a shaft 42*a* at its proximal end, which is rotatably supported by a bearing (not shown). Therefore, the base plate 42 is pivoted about the shaft 42*a*.

A gear 43 which is rotate and driven by the pulse motor M1 is rotatably fitted on the shaft 42*a*. The gear 43 is meshed with a gear 44 which is located at a distal end portion of the base plate 42. The gear 44 is integrally fixed to the shaft 28*a* to which the lower discharge rollers 28 are coaxially fixed, and the shaft 28*a* rotatably extends through the distal end portion of the base plate 42. The base plate 42 and the gear 44 are coupled to each other through a frictional transmission mechanism constituted by a spring 45 and a frictional plate 46 which is urged against the distal end portion of the base plate 42 by the biasing force of the spring 45. That is, a frictional torque determined by the biasing force of the spring 45 and the frictional coefficients of the frictional plate 46 and the base plate 42 is given as $T_1$, and a load torque is given as $T_2$. In this case, $$\text{if } T_1 > T_2,$$

the gear 44 is fixed to the base plate 42 by the frictional torque $T_1$ of the frictional transmission mechanism. For this reason, the gear 44 is rotated around the gear 43 upon rotation of the gear 43. In this manner, the base plate 42 is rotated clockwise about the shaft 42*a* as indicated by an arrow A, and the lower discharge rollers 28 are separated from the upper discharge rollers 29.

When the base plate 42 which is pivoted downward 5 abuts against a stopper (not shown), $$T_1 < T_2$$

In this case, the gear 44 is rotated against the friction torque $T_1$ upon rotation of the gear 43. The lower discharge rollers 28 are rotated clockwise as indicated by the arrow A. Since the lower discharge rollers 28 are already separated from the upper discharge rollers 29, the discharge operation is substantially stopped.

In a state wherein the lower discharge rollers 28 are separated from the upper discharge rollers 29, assume that the pulse motor M1 is reversed and begins to rotate counterclockwise as indicated by an arrow B. In this case, in contrast to the case of:

$$T_1 > T_2$$

plate 42 is rotated counterclockwise about the shaft 42*a*, and the lower discharge rollers 28 are urged against the upper discharge rollers 29. As a result, $$T_1 < T_2.$$

Upon counterclockwise rotation of the gear 43, the gear 44 is rotated clockwise. Thus, along with the rotation of the gear 44, the discharge rollers 28 and 29 are rotated to be in rolling contact with each other. In this manner, the paper discharge operation is executed In this case, the rotating directions of the gears 38 and 44 have the relationship as indicated by arrows shown in FIG. 8. More specifically, the pulse motor M1 is rotated in one direction, the gear 38 is rotated in a direction indicated by an arrow A, and the platen roller 22 is similarly rotated in the direction indicated by the arrow A through the unidirectional clutch CL. In addition, the base plate 42 is pivoted in the direction indicated by the arrow A, so that the discharge rollers 28 and 29 are separated from each other, as described above.

In this manner, the base plate 42 abuts against the stopper (not shown) to increase a load, the gear 44 is rotated in the direction indicated by the arrow A. More specifically, the platen roller 22 is always rotated against the frictional torque $T_1$. A vibration or the like of the platen motor 22 during intermittent rotation of the motor M1 can be prevented by the frictional torque $T_1$, and hence, paper feed precision can be improved.

When the pulse motor M1 is rotated in a direction opposite to the one direction described above, the gear 38 is rotated in a direction indicated by an arrow B. However, the rotation of the gear 38 is not transmitted to the platen roller 22 by means of the unidirectional clutch CL, and the platen roller 22 is stopped. The base plate 42 is pivoted in the direction indicated by the arrow B, and both the discharge rollers 28 and 29 are brought into contact with each other. Then, the gear 44 is rotated in the direction indicated by the arrow B, and the discharge rollers 28 are rotated to discharge the sheet P. More specifically, the sheet P clamped between the discharge rollers 28 and 29 are discharged.

With this unidirectional clutch CL, even if the sheet P is caught the midway along the convey path, reverse insertion of the sheet P into the platen roller 22 can be prevented. In addition, a load of the rotation system for the platen roller 22 can be removed and only the driving force for the discharge rollers 28 is required. For this reason, stability of the paper discharge operation can be improved. In particular, in a variety of severe environments, a sheet can be stably discharged. Note that the discharged sheet P is stacked on the stacker portion 26*a*, and can be picked up from a discharge port 11.

To summarize the arrangement of the paper feed/discharge system, upon reverse rotation of the pulse motor (paper feed motor) M2, the paper feed rollers 18 are rotated in the direction indicated by the arrow B, and the sheet P is fed in a reverse direction to enter a gap (t) between the separation portions 15*d* and 16*a* to be separated. Next, the pulse motor M2 is reversed and is rotated in a normal direction, so that the paper feed rollers 18 are rotated in a direction indicated by the arrow A, and the sheet P is fed toward the platen roller 22.

In this case, the leading end of the sheet is lifted due to the influence of the guide projection 14*e* of the inner plate 14, and is conveyed toward the platen roller 22 without abutting against the front press 2*d*. The picked-up sheet P is conveyed to the rolling contact portion between the platen roller 22 and the lower register rollers 21 through the paper guides 19 and 20. In this state, since the rotation of the platen roller 22 is stopped, skew of the sheet at the rolling contact portion can be corrected. In this case, since the second sheet P and other remaining sheets are pressed by the front press 2*d*, double feeding may not occur.

The pulse motor M1 is rotated in one direction to slightly rotate the platen roller 22 in the direction indicated by the arrow A, thereby causing the sheet P to enter a gap between the platen roller 22 and the register rollers 21. The motor M1 is then stopped. Then, the pulse motor M2 is rotated, and the movable paper guide 27 is moved to the point D upon rotation of the pulley 25. Furthermore, the pulse motor M1 is rotated to feed the sheet P through a paper guide section constituted by the press spring 34 and the movable paper guide 27, so that the leading end of the sheet P is inserted in a gap between the upper pinch rollers 23 and the platen roller 22.

The pulse motor M2 is then rotated to return the paper feed rollers 18 to their initial positions (positions indicated by the solid lines in FIG. 8) and to return the movable paper guide 27 to the point C, thus allowing a printing operation. The pulse motor M1 is rotated to feed the sheet P. When the trailing end of the sheet P is disengaged from an urging point between the platen roller 22 and the pinch rollers 23, the pulse motor M2 is rotated in a reverse direction, so that the discharge rollers 28 are moved from the dotted line position to the solid line position (FIG. 8) to be in contact with the discharge rollers 29. Moreover, the discharge rollers 28 are rotated in the direction indicated by the arrow B to discharge the sheet.

The detailed operation of this embodiment will be described later.

Note that the separating/approaching operation of the lower discharge rollers 28 with respect to the upper discharge rollers 29 need not necessarily be achieved by planetary gear motion of the gear 44 by utilizing friction. For example, this operation may be achieved by a known cam mechanism.

Control Circuit

Figure 11:
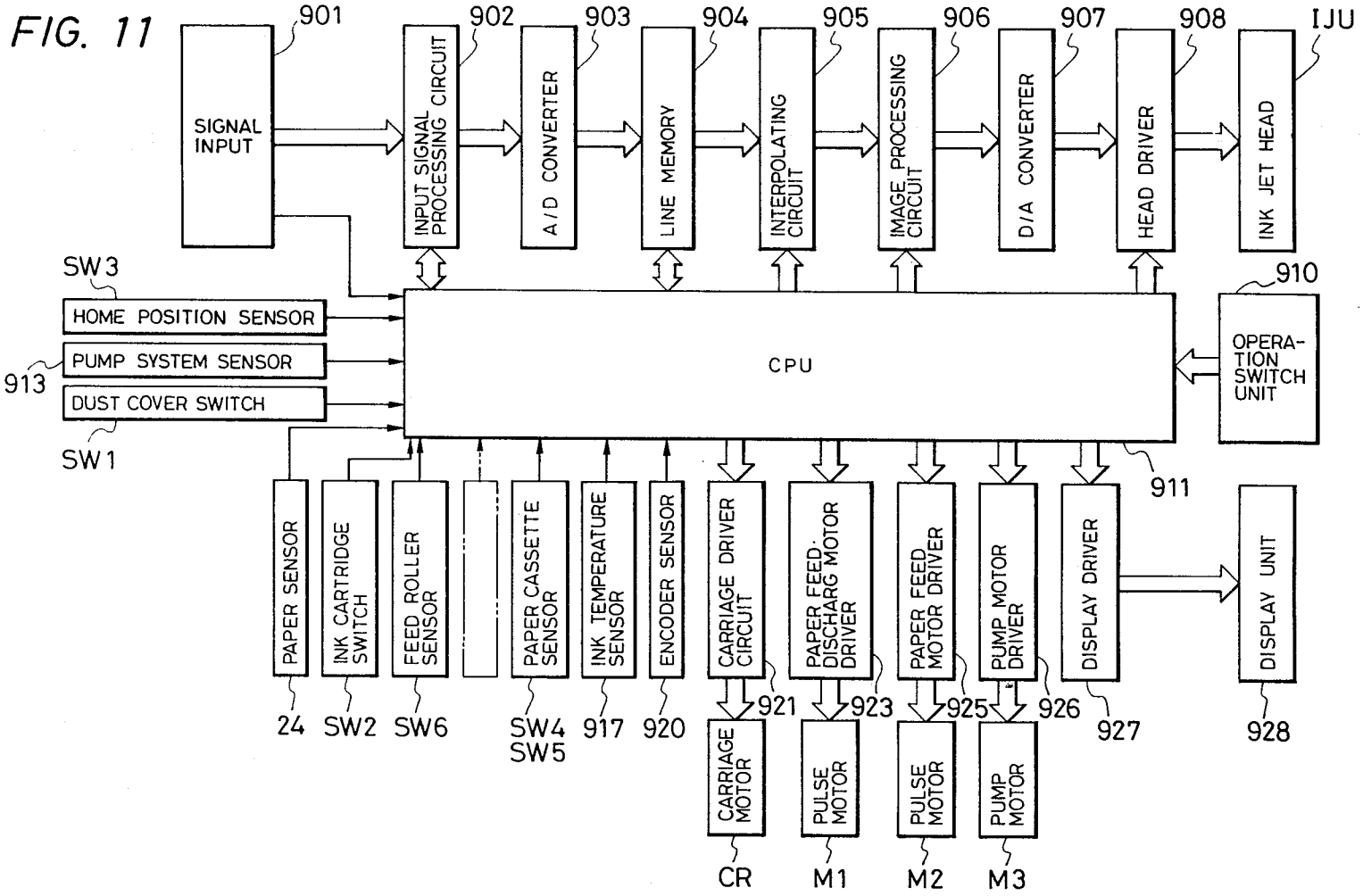
FIG. 11 is a block diagram showing the connection relationship among a CPU in a control system of the printer apparatus and various units and devices.

FIG. 11 is a block diagram of a control unit of the apparatus according to this embodiment. In FIG. 11, the control unit comprises a central processing unit (CPU) 911 serving as a main controller of the printer apparatus. The CPU 911 stores control programs shown in, e.g., FIGS. 12A to 12H in a ROM (not shown), and executes these programs to control the following peripheral circuits.

The CPU 911 is connected to a signal input unit 901. The CPU 911 receives, through the signal input unit 901, an RGB color image signal or an NTSC, PAL, or SECAM color television signal, or various color image signals formed by a personal computer or the like. The CPU 911 is also connected to an input signal processing circuit 902 for converting a color image signal other than the RGB signal into an RGB signal, a line memory 904 for storing color image data for a plurality of lines, an interpolating circuit 905 used when a color image is to be expanded, an image processing circuit 906 for performing masking processing, undercolor removal processing, and the like, of color image data, a drive circuit 908 for the ink-jet head IJU, and the like.

Note that the line memory 904 is connected to an A/D converter 903 for converting an analog RGB image signal from the input signal processing circuit 902 into digital RGB image data. The head driver 908 is connected to a D/A converter 907 for converting color image data from the image processing circuit 906 into an analog image signal. The head driver 908 is also connected to the piezo-type ink-jet head IJU.

Furthermore, the CPU 911 is connected to an operation switch unit 910. The operation switch unit 910 includes the power switch 6, the printing switch 8, the pump switch, and the like. The CPU 911 is connected to a sensor 913 for the pump system, an ink temperature sensor 917, an encoder sensor 920, a carriage motor driver 921, a driver 923 for the motor M1, a driver 925 for the motor M2, a driver 927 for an LED display unit 928, and the like. The LED display unit 928 includes the display LEDs *7a* to *7e*.

The operation will be described below.

Cassette Operation

When the knob 5 for loading/unloading the cassette is moved to the left against the biasing force of the spring 13, locking between the pin 5*a* fixed to the knob 5 and the cam portion 2*a* formed on the lower surface of the cassette 2 is released, and the cassette 2 is partially ejected outside the printer body 1 by the biasing force of the return spring 31 shown in FIG. 8. Then, the pushed-out cassette 2 is stopped at a position where the cam portions 15*c* of the separation levers 15 are in contact with the guides 17. As a result, both the cassette size sensors SW4 and SW5 are turned off. When the cassette 2 is manually pulled out, the cam portions 15*c* climb over the lower surfaces of the guides 17 and the entire cassette 2 can be pulled out.

In FIG. 5, when the separation levers 15 are rotated about the pivots 15*a* of the separation levers 5 in the direction indicated by the arrow A, the cam portions 15*b* and 15*c* are brought into contact with the contact portions 14*d* of the inner plate 14 shown in FIG. 5 and push down the inner plate 14, as shown in FIG. 5. In particular, the leading end portion of the sheet P placed on the inner plate 14 is lowered, and a gap between the sheet and the front press 2*d* is increased. As a result, the separation levers 15 are held in position due to their own moments and operation of the cams even if the operator releases his hand therefrom. Thus, the operator can load the sheets P along the direction indicated by the arrow B. When the separation levers 15 are returned after the sheets are loaded, the inner plate 14 is pushed upward by the biasing forces of the coil springs 33*a* and 33*b* until the upper portion of the leading end of the sheet abuts against the front press 2*d*.

As shown in FIG. 2, the cassette 2 is inserted in the paper feed port 11 of the printer body 1. As a result, the cam portions 15*c* of the separation levers 15 are pushed down by the guides 17 shown in FIG. 8, and hence, the separation plates 16 attached to the separation levers 15 are pushed downward. Then, the trailing end portion of the sheet is pushed down, and the longitudinal curl of the sheet is corrected by the projection 14*b*. When the cassette 2 is further pushed inwardly against the biasing force of the spring 31, the cam portions 15*b* and 15*c* slide over the guides 17, the cam portion 2*a* of the cassette 2 pushes away the pin 5*a*, thereby locking the cassette when the pin 5*a* slides over the cam portion 2*a*. In this state, the projection 35 of the printer body 1 aligns the distal end portion of the cassette 2 as shown in FIG. 8. When the small-sized cassette is selected, the switch SW4 is turned on, and when the large-sized cassette is selected, the switch SW5 is turned on. In this manner, the cassette 2 can be easily and reliably set in the printer body 1.

After loading, the leading end portions of sheets P are urged against the front press 2*d* by the cassette spring 33*a* at an appropriate pressure through the inner plate 14. At the trailing end portions of the sheets, there is no fixed member such as the front press 2*d*, and the separation lever unit consisting of the separation levers 15 and the separation plates 16 can be pivoted. Therefore, the upward pivotal movement of the separation levers 15 is regulated by the guides 17, and the sheets P are urged against the separation plates 16 fixed to the separation levers 15 by the rear cassette spring 33*b* through the inner plate 14.

In this manner, when the cassette 2 is loaded to the printer body 1, the leading and trailing end portions of the uppermost sheet P are urged against the front press 2*d* and the separation plates 16 by the upward biasing forces. Therefore, even if the number of stacked sheets is changed, the uppermost sheet can maintain a constant level with respect to the paper feed rollers 18.

FIGS. 12A to 12H are flow charts of various control programs executed by the CPU 911.

Initialization Process

Figure 12A:
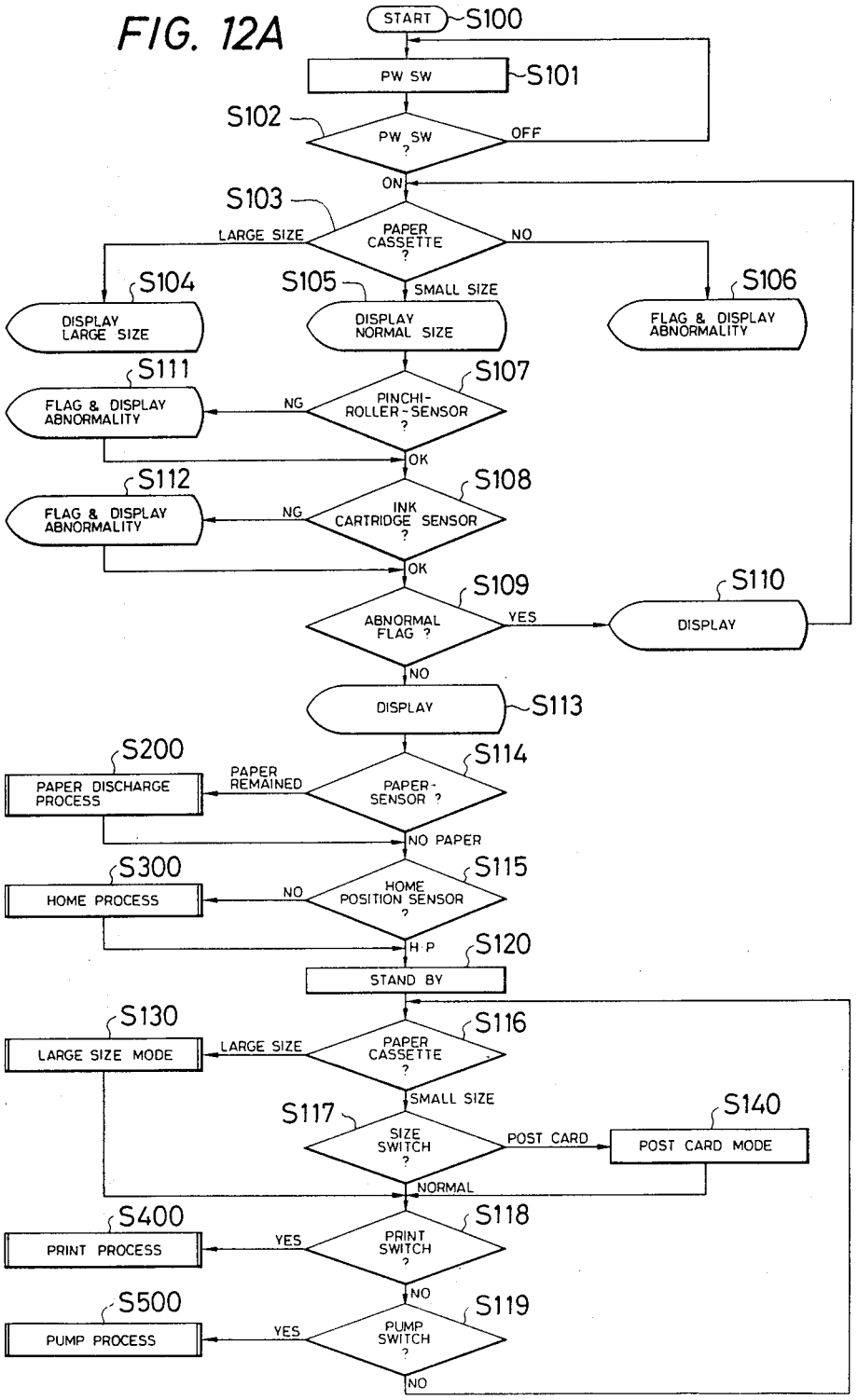
FIG. 12A is a flow chart of an initialization from power-on to a standby state.

FIG. 12A is a flow chart of an initialization process from power-on to a standby state of the printer apparatus. In step S101, an operator depresses the power switch 6. In step S102, the present state of the power switch 6 is checked. If the switch 6 is ON, the switch 6 is turned off and the flow returns to step S101. If the switch 6 is OFF, the switch 6 is turned on and the flow advances to step S103. Note that the above operations are performed by the power supply circuit, and are not related to the processing of the CPU 911.

The test and indication of conditions necessary for starting a printing operation are performed. That is, in step S103, a loading state of the cassette 2 is checked. If the cassette 2 is not loaded, an abnormality flag is set is in step S106, and the LED 7*a* is flickered to inform the operation of the abnormarlity of the paper feed system. When the cassette 2 is loaded, if the large-sized cassette (SW=ON) is selected, an indication is made to inform the operator that the large-size mode is selected in step S104. If the small-sized cassette (SW4=ON) is selected, an indication is made to inform the operator that a normal-size mode is selected in step S105. In step S107, the pinch roller sensor is checked. If an abnormality is found, an abnormality flag is set in step Slll, and the abnormality of the paper feed system is indicated to the operator.

If no abnormality is found, the ink cartridge sensor SW2 is checked in step S108. If no ink cartridge 10 is loaded, an abnormality flag is set in step S112, and the LED 7*b* is flickered to inform the operator of abnormality of the ink system. If the ink cartridge 10 is loaded, the set/reset state of the abnormality flag is checked in step S109. If the abnormality flag is set, the abnormality is indicated to the operator in step S110, and the flow returns to step S103. If no abnormality flag is set, a normal state is indicated to the operator in step S113.

In step S114, the paper sensor 24 is checked. If the sheet P is left in the convey path, a paper discharge process described later in step S200 is executed. If no sheet P is left, the home position sensor SW3 is checked in step S115. If the carriage 201 is not located at the home position, a home process described later in step S300 is executed.

As a result, if no abnormality is found, the apparatus is set in the standby state in step S120. In the standby state, cassette exchange, a printing command, and a pump command are accepted. That is, if loading of the large-sized cassette is detected in step S116, the large-size mode is selected in step S130. If loading of the small-sized cassette is detected in step S116, the size switch is checked in step S117. If the size switch is selected to be a post-card size, the post card mode is selected. If the post-card size is not selected, the normal mode is selected. If depression of the printing switch 8 is detected in step S118, a printing process step S400 (to be described later) is executed. If depression of the pump switch is detected in step S119, a pump process S500 (to be described later) is executed.

Printing Process

Figure 12B:
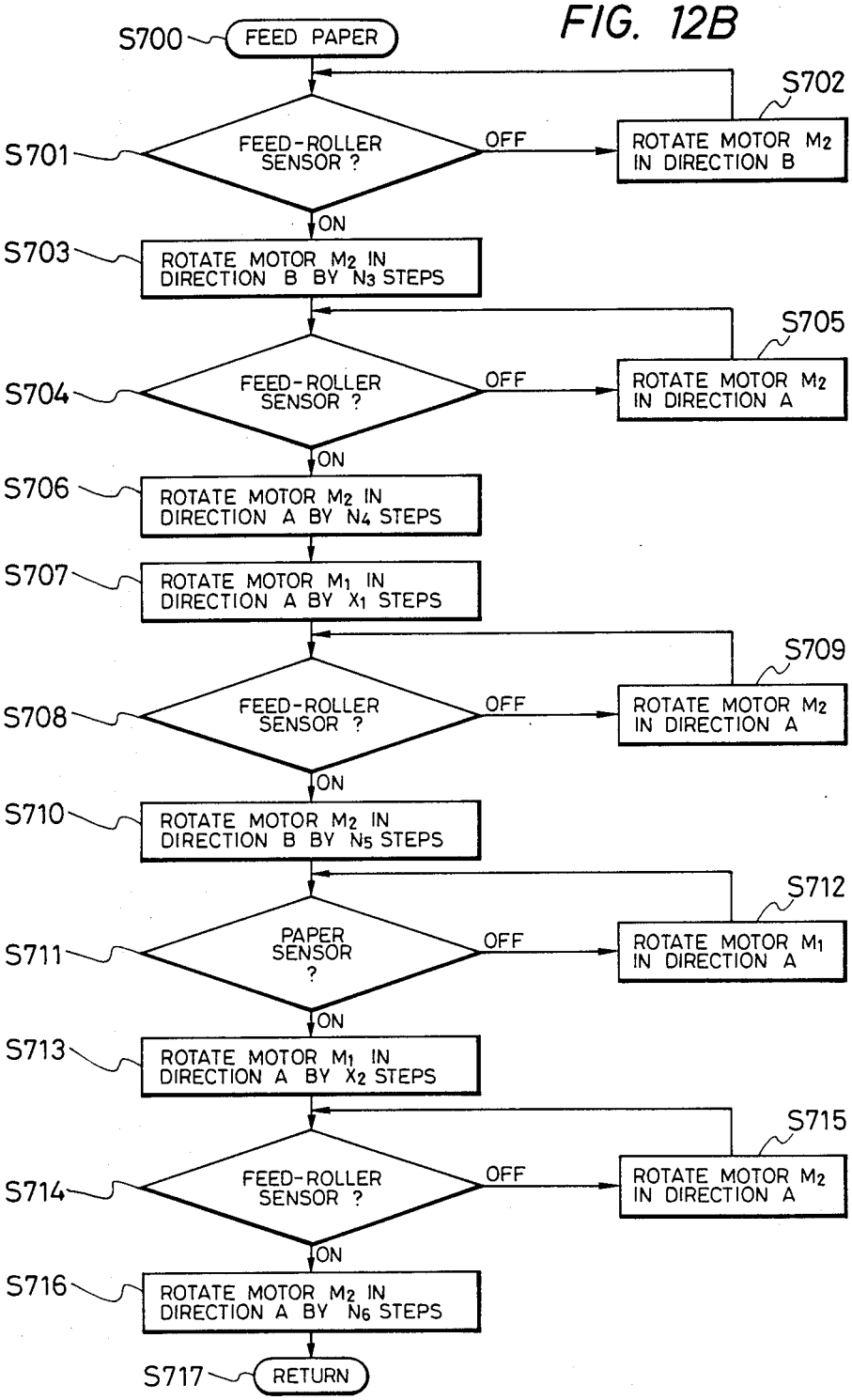
FIG. 12B is a flow chart of a paper feed process.
Figure 12C:
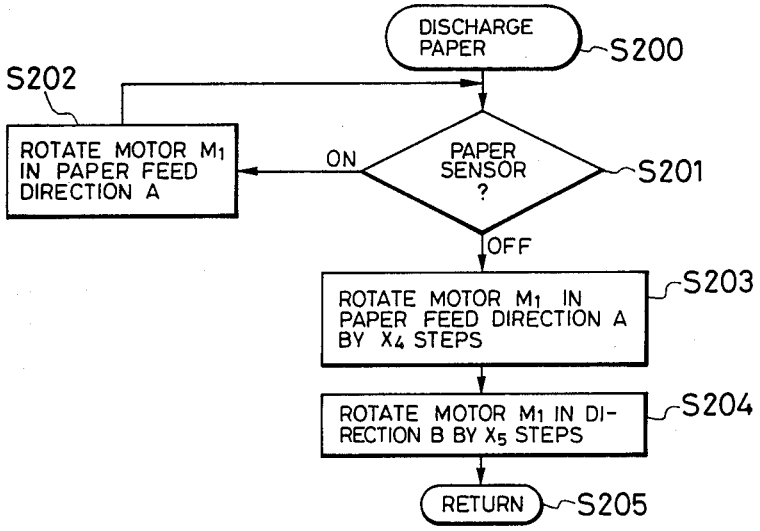
FIG. 12C is a flow chart of a paper discharge process.
Figure 12D:
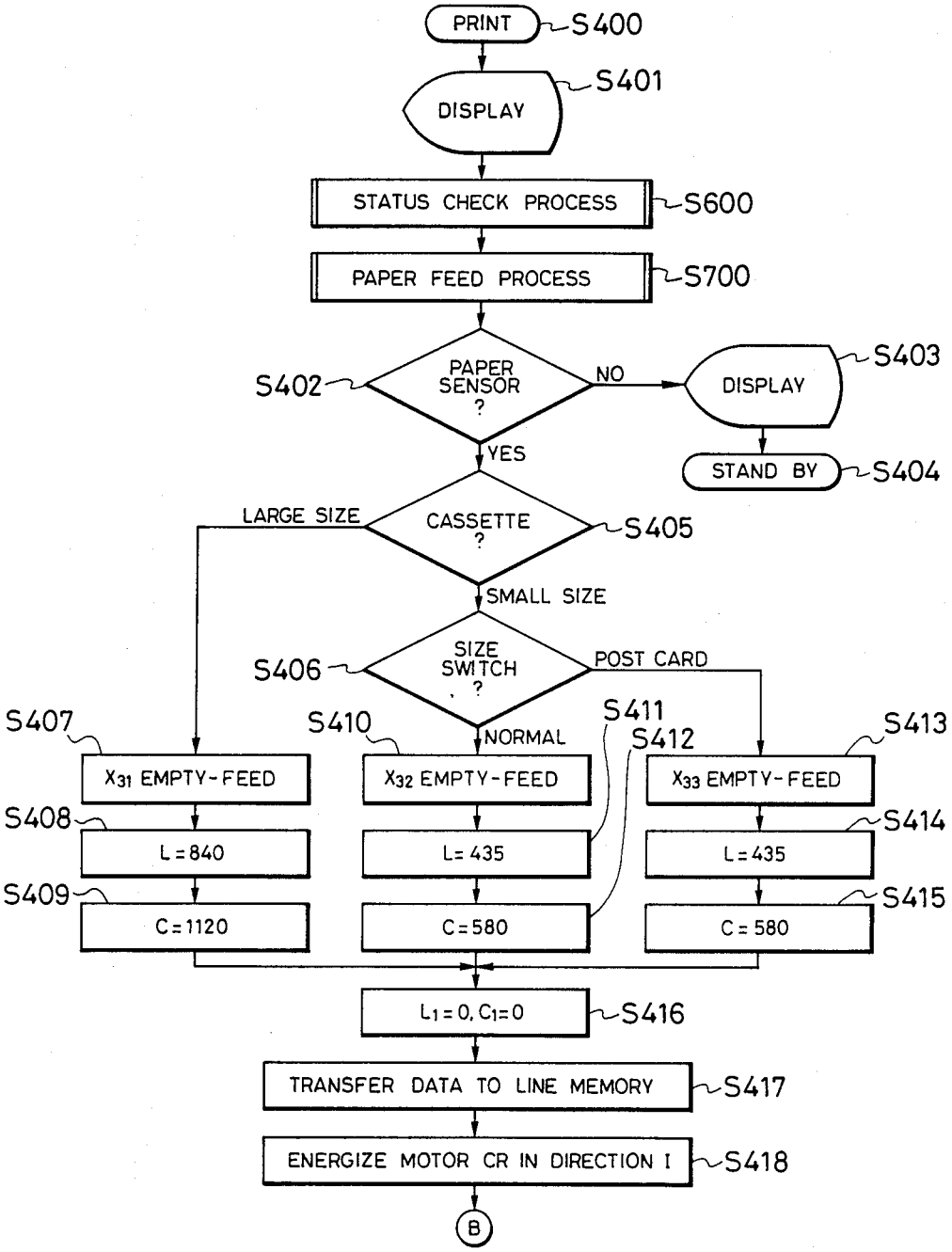
FIGS. 12D to 12F are flow charts of a printing process.
Figure 12E:
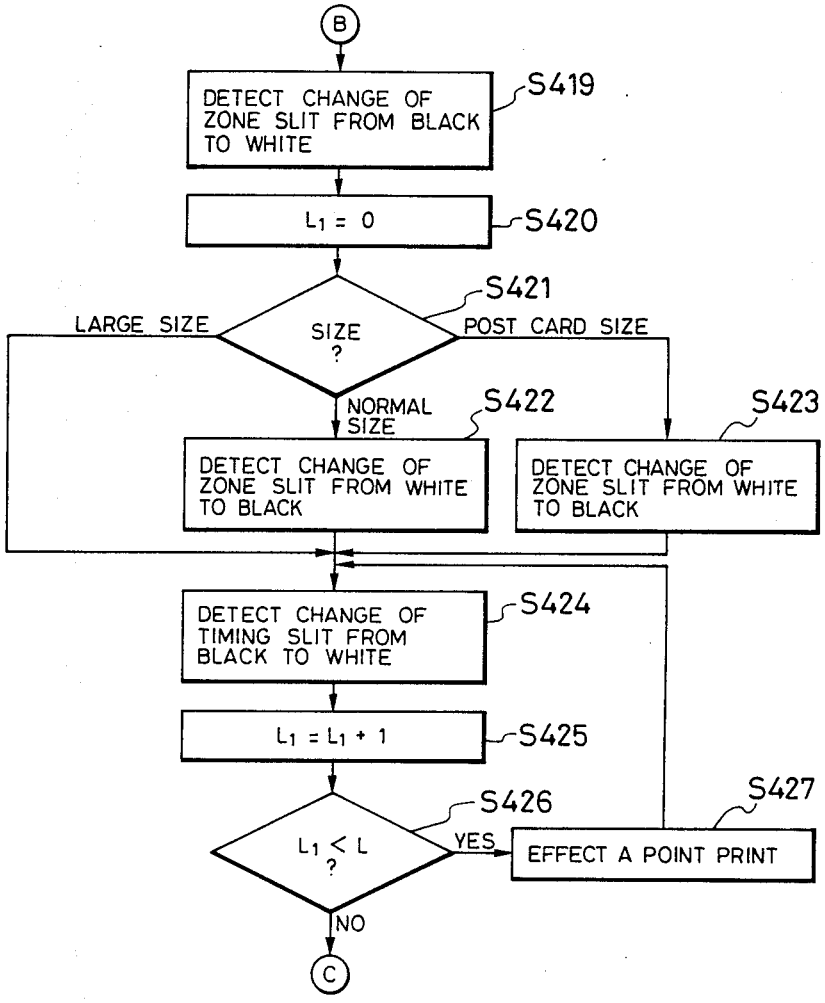
Figure 12F:
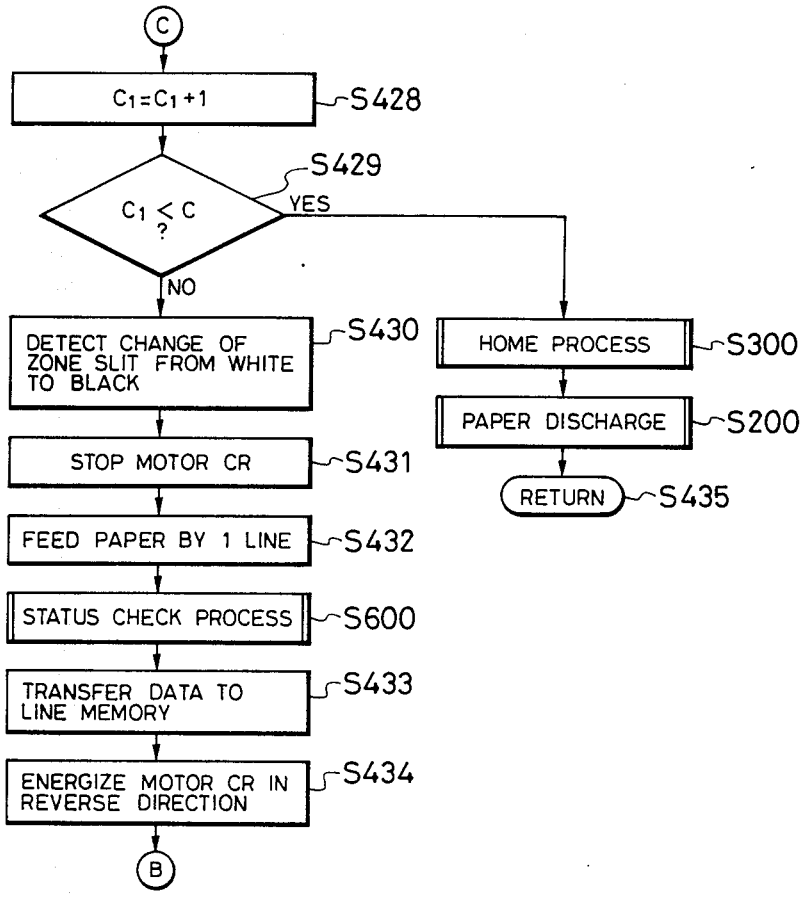
Figure 12G:
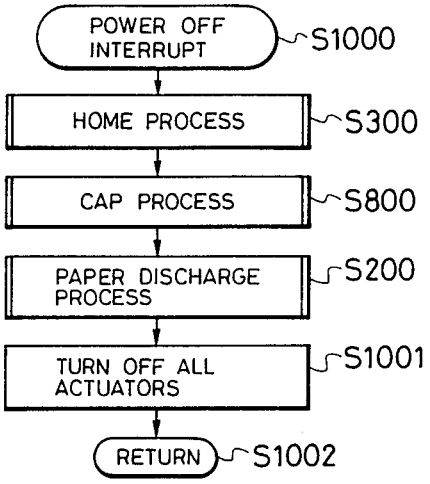
FIG. 12G is a flow chart of an interrupt operation when a power supply is OFF.

FIGS. 12D to 12F are flow charts of the printing process. The printing process consists of a status check process before paper feed, a paper feed process, a printing process, and a discharge process.

If depression of the printing switch 8 is detected in step S118, the print LED 8a is turned on in step S401 to inform the printing operation. In step S600, the following status check process is executed as inspection before the printing operation is started in order to determine if the printing operation may proceed, and to alert the operator if necessary.

Status Check Process

Figure 12H:
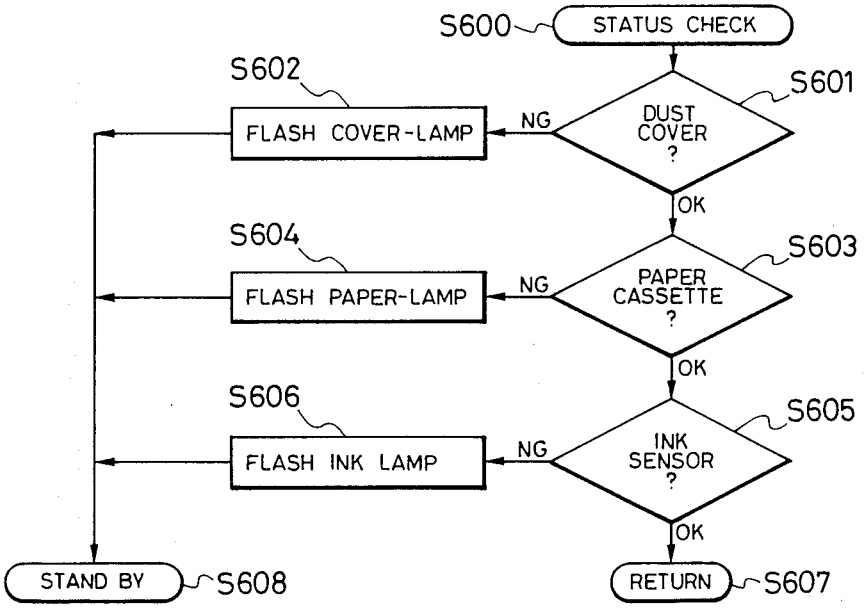
FIG. 12H is a flow chart of a status check process.

FIG. 12H is a flow chart of the status check process. In step S601, the dust cover sensor SWI is checked. If the dust cover 4 is closed (SW1=ON), the LED 7*a* is flickered in step 602 to inform the operator of the abnormality in the paper feed system since the dust cover 4 interferes the paper discharge operation. The flow then advances to step S608, and the apparatus is set in the standby state. The standby state is canceled when the operator opens the dust cover 4. This also applies to the following processes. In step S603, the cassette sensors SW4 and SW5 are checked. If no cassette is loaded (SW4=OFF and SW5=OFF), the LED 7*a* is flickered to inform the operator of abnormality in the paper feed system in step S604. Then, the apparatus is set in the standby state.

In step S605, the ink cartridge sensor SW2 is checked. If no ink cartridge 10 is loaded (SW2=OFF), the LED 7*b* is flickered to inform the operator of abnormality in the ink system, and the apparatus is set in the standby state. If no abnormality is found, the apparatus is normal, and the following paper feed process is executed.

Note that in the initialization process, although the OFF state of the paper sensor 24 (step S114) and the ON state of the home position sensor SW3 (step S115) necessary for starting the printing operation are achieved, since the abnormalities thereof must always be checked, these test steps may be included in the status check process.

Paper Feed Process

FIG. 12B is a flow chart of the paper feed process. The paper feed process consists of the separation process for separating an uppermost sheet $P_1$ from the cassette 2, and a convey process for feeding the separated sheet to the platen roller 22.

(1) Separation Process

In the separation process, the uppermost sheet $P_1$ in the cassette 2 is picked up and separated in a reverse direction (opposite to the convey direction). In steps S701 and S702, the pulse motor (paper feed motor) M2 is rotated in the reverse direction until the paper feed rollers reach an initial position $\alpha_0$ in FIG. 10A (SW6=ON). With this operation, the paper feed rollers 18 which have been slightly rotated toward the convey direction are returned to the initial position $\alpha_0$.

If the initial position $\alpha_0$ is detected in step S701, the pulse motor M2 is further rotated in the reverse direction by an $N_3$ step in step S703. Thus, the cam portions 18*b* formed of a resin having a relatively small frictional force of the paper feed (semilunar) rollers 18 begin to be in contact with the uppermost sheet $P_1$. If the number of stacked sheets is changed, the paper feed rollers 18 always maintain a constant level with respect to the uppermost sheet $P_1$. Therefore, an angle at which the cam portions 18*b* of the rotating paper feed rollers 18 are brought into contact with the uppermost sheet $P_1$ always becomes constant.

In this case, assuming that a frictional force between the uppermost sheet $P_1$ and the second sheet $P_2$ is given as $\mu_2$, a frictional force $\mu_1$ between the cam portions 18*b* and the uppermost sheet $P_1$ is set to have the following relationship with the frictional force $\mu_2$:

$$\mu_1 < \mu_2$$

For this reason, when the paper feed rollers 18 are further rotated, the stacked sheets P and the inner plate 14 are pressed downward against the biasing force of the coil spring 33*b* upon operation of the cam portions 18*b*.

Along with the downward movement of the stacked sheets P, the separation levers 15 are disengaged from the guides 1, and the separation plates 16 abut against the upper portion of the trailing end of the uppermost sheet $P_1$ by their own weight accompanying moments. Since the separation levers 15 are disengaged from the guides 17, the biasing force of the coil spring 33*b* serves to press the uppermost sheet $P_1$ against the cam portions 18*b* of the paper feed rollers 18. In this case, as will be described later, a pressing force for causing the rubber portions 18*a* of the paper feed rollers 18 to feed he uppermost sheet $P_1$ forward/backward is obtained.

When the paper feed rollers 18 are further rotated, the rubber portions 18*a* having a relatively large frictional force of the paper feed rollers 18 begin to abut against the uppermost sheet $P_1$. In this case, if a frictional force between the rubber portions 18*a* and the uppermost sheet $P_1$ is given as $\mu_3$, the following relationship is established between the frictional force $\mu_3$ and the frictional force $\mu_2$ between the uppermost sheet $P_1$ and the second sheet $P_2$:

$$\mu_2 < \mu_3.$$

The uppermost sheet $P_1$ is slided moved backward (in a direction opposite to the convey direction) upon rotation of the rubber portions 18*a*, and the trailing end portion of the uppermost sheet $P_1$ is fed toward the gap t between the separation portions 15*d* and 16*a*.

The separation portion 15*a* has an angle $\theta$ with respect to the moving direction of the sheet P, as shown in FIG. 6A. Thus, the trailing end portion of the uppermost sheet $P_1$ can be guided along the separation portion 16*a* toward the gap t. The separation portion 15*d* also has an angle $\theta$, and hence, the gap t can be maintained constant.

Figure 10A:
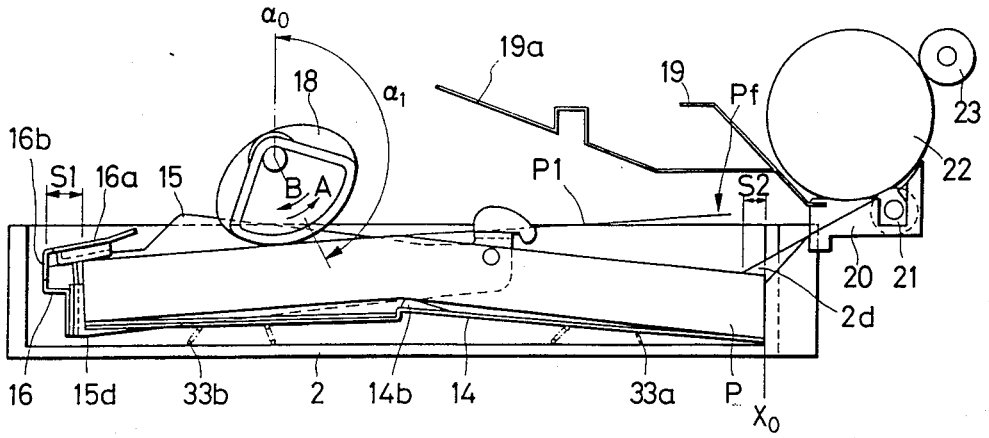
FIG. 10A is a side sectional view showing a state of sheet separation by a paper feed roller.

While the trailing end portion of the uppermost sheet $P_1$ is guided toward the gap t, its leading end portion is pulled out from the front press 2*d*, and as shown in FIG. 10A, the first half portion of the uppermost sheet $P_1$ is lifted upon operation of the bending step and the projection 14*b* of the inner plate 14. Thus, the uppermost sheet $P_1$ can be completely separated from the second sheet $P_2$. In this case, if the pressing force of the coil spring 33*a* against the front press 2*d* is too small, a sheet other than the uppermost sheet $P_1$ (in particular, the second sheet) is also pulled out from the front press 2*d*. Contrarily, if the force is too large, the rubber portions 18*a* provides sufficient pulling force, and the sheet cannot be separated. Therefore, the biasing force of the coil spring 33*a* is determined in consideration of the pressing force of the sheet P against the front press 2*d*.

A feed amount $N_3$ of the pulse motor M2 is determined in consideration of the following respects. That is, if a distance from when the trailing end portion of the uppermost sheet $P_1$ passes through the gap t and until it abuts against the abutting portions 16*b* of the separation plates 16 (separation amount) is given by $S_1$, the following relationship is set between the amount $S_1$ and a size $S_2$ of the front press 2*d*:

$$S_1 > S_2$$

In this manner, when the backward movement of the trailing end portion of the uppermost sheet $P_1$ is regulated by the abutting portions 16, the leading end portion of uppermost sheet $P_1$ can be reliably pulled out from the front press 2*d*.

Therefore, the rotational angle $\alpha_1$ of the paper feed rollers 18 in step S703, i.e., the feed amount $N_3$ step of the pulse motor, is determined in consideration of the separation amount $S_1$. Since the cam portions 18*b* of the paper feed rollers 18 abut against the uppermost sheet $P_1$ at the constant angle, as described above, a paper feed amount added to the angle during separation can be constant. Therefore, the total feed amount $N_3$ step of the pulse motor M2 can be made constant. Thus, simple control and a simple arrangement can be facilitated. Note that the value $N_3$ is set to be slightly larger in consideration of a margin under various circumstances.

(2) Convey Process

In the convey process, the separated uppermost sheet $P_1$ is fed in a forward direction (convey direction). In steps S704 and S705, the pulse motor M2 is rotated in a forward direction (A direction of the rollers 18) until the paper feed rollers 18 reach the initial position $\alpha_0$. Thus, the paper feed rollers 18 are rotated through the rotational angle $\alpha_1$, and are returned to the initial position $\alpha_0$. The rubber portions 18*a* are operated in a manner opposite to the separation operation to convey the leading end portion of the uppermost sheet $P_1$ to a paper initial position $X_0$ above the front press 2*d*.

In this state, since the trailing end portion of the uppermost sheet $P_1$ has passed through the gap t, a load when the uppermost sheet $P_1$ passes through the gap and a damage due to contact with the gap can be prevented in the following convey operation, thus allowing a stable convey operation. In particular, when a thick sheet (e.g., a thickness of about 0.25 mm) is used, variations in load during printing largely influence printing precision. Therefore, this embodiment free from the load after separation is very effective.

Figure 10B:
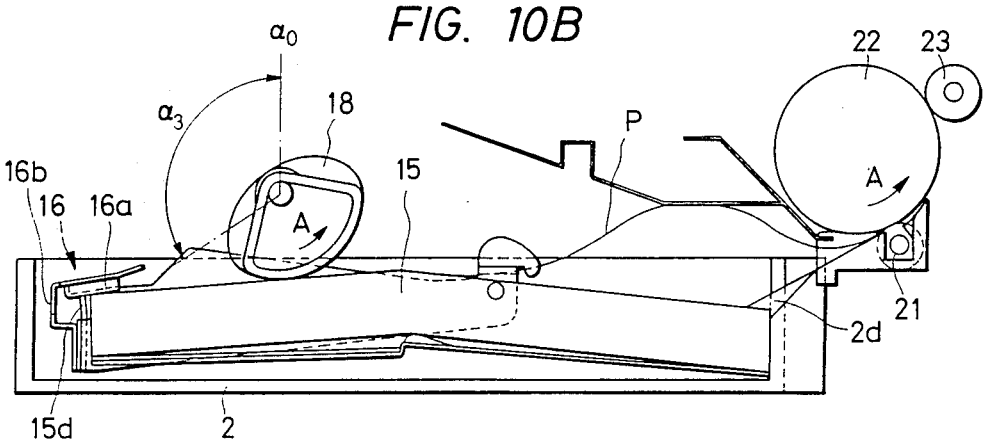
FIG. 10B is a side sectional view showing a state of a separated sheet to be conveyed to a rolling contact portion between a platen roller and register rollers.
Figure 10C:
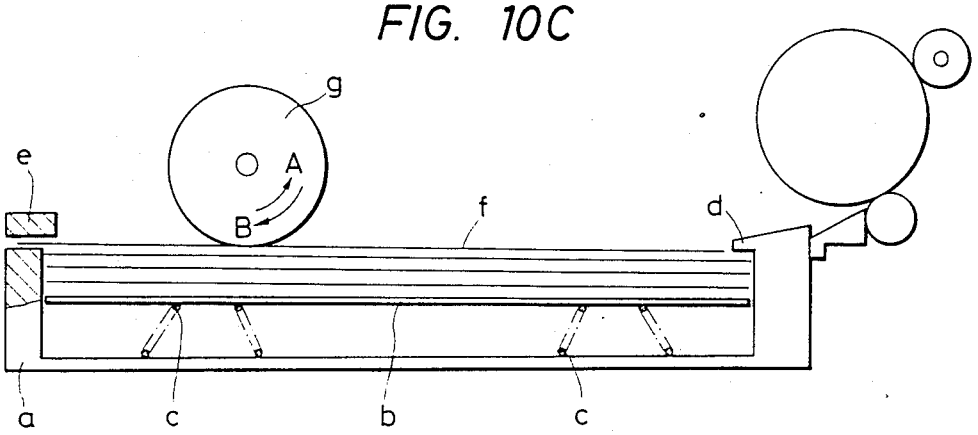
FIG. 10C is a side view showing a conventional positional relationship among a paper feed roller, a platen roller, and register rollers.

Since the initial position $\alpha_0$ is detected in step S704, the pulse motor M2 is further rotated by an $N_4$ step in a forward direction. The paper feed rollers 18 are rotated by a rotational angle $\alpha$ (not shown) in the A direction from the initial position $\alpha_0$. The separated uppermost sheet $P_1$ is fed toward the platen roller 22 by the convey force of the rubber portions 18*a* against which the sheet abuts. The leading end portion of the separated sheet P abuts against the outer peripheral surface of the platen roller 22 along the paper guides 19 and 20. When the paper feed rollers 18 are further rotated, a loop is formed in the separated sheet below the paper guide 19, as shown in FIG. 10B.

When the paper feed rollers 18 are further rotated, the loop is grown and abuts against the flat portion 19*a* of the paper guide 19. Thus, a convey force from a spring force based on the loop is generated in the separated sheet, and the leading end portion of the sheet can reliably abut against the rolling contact portion between the register rollers 21 and the platen roller 22. In this manner, skew of the separated sheet is corrected, and the paper feed rollers 18 are temporarily stopped at an angle $\alpha_3$. In this manner, even if the sheet is slightly curled, the sheet can reliably reach the rolling contact portion between the register rollers 21 and the platen roller 22 by the propelling force based on the spring force of the sheet itself.

In step S707, the pulse motor (paper feed motor) M1 is rotated by an $X_1$ step in the convey direction. Thus, the platen roller 22 is slightly rotated in a direction indicated by an arrow A in FIG. 10B, so that the leading end portion of the sheet P is gripped at the rolling contact portion between the platen roller 2 and the register rollers 21.

In steps S708 and S709, the pulse motor M2 is rotated in the convey direction until the paper feed rollers 18 have reached the initial position $\alpha_0$. The paper feed rollers 18 are completely separated from the separated sheet P, and releases the second half of the separated sheet P.

In step S710, the pulse motor M2 is rotated by an $N_5$ step in the reverse direction. Thus, the paper feed rollers 18 shown in FIG. 18 are rotated from the initial position $\alpha_0$ by an angle $\alpha_4$ in a direction indicated by an arrow B, and the pulley 18*d* coaxial with the paper feed rollers 18 and the pulley 25 which is 1:1 coupled thereto through the toothed belt 36 are rotated through the angle $\alpha_4$. The pin 25*a* integrally formed on the pulley 25 pushes out the cam portion 27*b* of the movable paper guide 27. The paper guide 27 begins to pivot in a direction indicated by the arrow B in FIG. 8 against the biasing force of the return spring 37. The distal end portion of the paper guide 27 is lowered to a position indicated by symbol D for forming a guide portion of the separated sheet P.

In steps S711 and S712, the pulse motor M1 is rotated in the convey direction until the paper sensor 24 is turned on. The paper sensor 24 detects the leading end portion of the separated sheet P slightly advanced from the register rollers 21, and can reliably guide the leading end portion of the separated sheet P toward the paper guide portion.

If it is detected in step S711 that the paper sensor 24 is ON, the pulse motor M1 is rotated by an $X_2$ step in the convey direction in step S713. Thus, the platen roller 22 is rotated in the direction indicated by the arrow A to convey the separated sheet P through the paper guide portion constituted by the press spring 34 and the movable paper guide 27. Thus, the leading end portion of the sheet P is inserted in the rolling contact portion between the platen roller 22 and the upper pinch rollers 23. In this case, since the movable paper guide 27 is formed coaxially with the platen roller 22, this gap can be designed to be small, and the gap of the paper guide portion can be made constant.

In this manner, when the sheet P is gripped between the platen roller 22 and the pinch rollers 23, the sheet P does not float from the platen roller 22. In step S714 and S715, the pulse motor M2 is rotated in the convey direction until the paper feed rollers 18 reach the initial position $\alpha_0$.

If the initial position of the paper feed rollers 18 is detected in step S714, the pulse motor M2 is rotated by an $N_6$ step in the forward direction in step S716. Thus, the paper feed rollers 18 are further rotated through an angle $\alpha_4$, and release the pin 25*a* of the pulley 25 from the cam portion 27*a* of the movable paper guide 27. In addition, the rollers 18 cause the movable paper guide 27 to retract to a position indicated by symbol C in the direction indicated by the arrow A in FIG. 8 by the biasing force of the spring 37, thus allowing a printing operation.

Printing Process

FIGS. 12D and 12E are flow charts of the printing process. The print mode includes three modes. When the paper size is large, the large-size mode is uniquely determined, and when the paper size is small, the normal mode or post card mode can be selected upon operation of the sub operation (mode) switch 12*a* before operation of the printing switch 8.

In step S402, the paper sensor 24 is checked. If no sheet is wound around the platen roller 22 in the above-mentioned paper feed process, the paper sensor 24 indicates a paper feed failure, and remains OFF. Thus, the LED 7*a* is flickered to inform the operator of abnormality of the paper feed system, and the apparatus is set in the standby state in step S404. If a sheet is wound around the platen roller 22, the paper sensor 24 indicates that, the paper feed operation is successful by remaining ON. Furthermore, the cassette size is checked in step S405. If the large size is selected, the pulse motor M1 is empty-fed by an $X_{31}$ step for forming a margin.

In step S408, data "840" is set in a dot-count register L in the carriage scanning direction, and in step S409, data "1120" is set in a line-count register C in the paper feed direction. If the small size is selected, the size switch is checked in step S406. If the normal size is selected, the pulse motor M1 is idled by an $X_{32}$ step in step S410. Furthermore, data "435" is set in the dot-count register L in step S411, and data "580" is set in the line-count register C in step S412.

If the post-card size is selected, the pulse motor M1 is empty-fed by an $X_{33}$ step in step S413. Furthermore, data "435" is set in the dot-count register L, and data "580" is set in the line-count register C in step S415. In step S416, a dot counter $L_1$ and the line counter $C_1$ are initialized to "0". In step S417, one-line image data is transferred to the line memory 904. In step S418, the linear motor (CR motor) for a carriage is driven in a direction thus starting a printing operation.

(1) One-point Printing Process

FIG. 12E is a flow chart of a one-point printing process. If a change from black (dark) to white (light) of a zone slit (in a case of reverse scanning, a reverse zone slit) is detected in step S419, this means that the carriage is located at the start position of the print zone, and in step S420, data "0" is set in the dot counter $L_1$. If the large-size mode is detected in step S421, the flow advances to step S424 to immediately start detection of a change from black to white of a timing slit 204*a*. If the change is detected, the dot counter $L_1$ is incremented by +1 in step S425. In step S426, the contents of the dot counter $L_1$ and the dot-count register L are compared with each other, and if $L_1 < L$, the flow advances to step S427, and a one-point printing operation is performed. Then, the detection of the next timing slit is performed. However, unless $L_1 < L$ in step S426, the one-line printing operation is completed, and the next line feed operation is performed.

Note that if the large-size mode is not detected in step S421, the flow advances to step S422 or S423 to await for detection of a change from white to black of the zone slit (in the case of reverse scanning, the reverse zone slit). Thus, a detection start timing of the timing slit 204a in step S424 is delayed to change a print zone.

(2) Line Feed Process

FIG. 12F is a flow chart of a line feed process. In step S428, the content of the line counter $C_1$ is incremented by +1. In step S429, the content of the line counter $C_1$ and the content of the line-count register C are compared with each other, and if $C_1 < C$, detection of a change from white to black of the reverse zone slit (in the case of the reverse scanning, the zone slit) is awaited in step S430. If the change is detected, this means the carriage is located at the end position of the line scanning, and in step S431, the CR motor is stopped.

In step S432, pulses corresponding in number to one line are supplied to the pulse motor M1, and the platen roller 22 is driven in the convey direction to feed the sheet by one line. In step S600, status check is performed as a precaution. In step S433, next image data for one line is transferred to the line memory 904. In step S434, in order to perform bidirectional scanning, the drive direction of the CR motor is reversed, and the flow returns to step S419.

Unless $C_1 < C$ in step S429, the one-page printing operation is completed, and the carriage is returned to the home position by the home process S300 (to be described later). In the paper discharge process step S200, a sheet is discharged.

Paper Discharge Process

FIG. 12C is a flow chart of the paper discharge process.

In steps S201 and S202, the pulse motor M1 is rotated until the output from the paper sensor 24 becomes OFF (no paper), so that the sheet P is fed until the trailing end portion of the sheet P wound around the platen roller 22 has passed by the paper sensor 24 portion. When the output from the paper sensor 24 is OFF, the flow advances to step S203, and the pulse motor M1 is further advanced by the $X_4$ step in the convey direction to further rotate the platen roller 22 in the convey direction.

The trailing end portion of the sheet P can be reliably discharged from a gap between the pinch roller 3 and the platen roller 22. In step S204, the pulse motor M1 is rotated by the $X_5$ step in the reverse direction, and the gear 43 in FIG. 9 is rotated in the direction indicated by the arrow B. Thus, the base plate 42 is pivoted in the direction indicated by the arrow B, and hence, the discharge rollers 28 which rotatably contact the pivoting end of the base plate 42 is rotated in the direction indicated by the arrow B. In this case, the sheet P has already been fed between the discharge rollers 29 and 28. Therefore, the sheet P is urged between the discharge rollers 28 and 29 by the rotating force of the base plate 2, and is discharged upon rotation of the discharge rollers 28.

Although not shown, when the output from the paper sensor 24 is OFF from the beginning of the paper discharge operation, rotation control until the output from the paper sensor 24 is OFF is omitted, and the pulse motor M1 is immediately rotated by the $X_4$ step in the convey direction. The base plate 42 is pivoted in the direction indicated by the arrow A, and the lower discharge rollers 28 are separated downward from the upper discharge rollers 29 to stand by below the paper guide 26. In this manner, the passage of the leading end portion of the sheet P is not interrupted. Therefore, the leading end portion of the sheet P is guided toward the paper guides 30 and 26b by the movable paper guide 27, and is fed between the pairs of the discharge rollers 28 and 29.

As described above according to the present invention, since one motor drives a feed means and a discharge means and also causes the discharge means to escape or move in order to disengage. Therefore, respective mechanisms can have high space factors, and a compact and low-cost apparatus can be provided.

According to the present invention, since the discharge means is escaped from the sheet guide portion during the printing operation, reliable sheet feeding by the feed means can be assured.

According to the present invention, the operations of the feed and discharge means are simply continued like a discharge operation after a printing operation. In addition, the structures of both the means are arranged as close as possible. Therefore, the structure and control of moving means arranged therebetween can be simplified.

According to the present invention, since the moving means employs a planetary gear mechanism, its structure is simple, and its operation can be stabilized.

According to the present invention, during the operation of the discharge means, power transmission to the feed means is interrupted to stop rotation of the feed means. Thus, the power is effectively used to operate only the discharge means through a simple combination of a stable friction mechanism and a planetary gear mechanism. Therefore, a single drive source can be effectively utilized. If a discharge port is closed due to disturbance, a sheet is not wound around the feed means, and can be reliably discharged. As a result, paper jam can be prevented.

What is claimed is:

1. A recording apparatus comprising:

a platen roller for feeding a sheet to be subjected to a recording operation;

a motor for providing a driving force in two directions;

a first transmission mechanism having a one-way clutch for transmitting the driving force of said motor to said platen roller only in a first driving direction of said motor;

a discharge roller for discharging a recorded sheet, said discharge roller being movable between a first position in which the recorded sheet can be discharged by said discharge roller and a second position in which the recorded sheet cannot be discharged by said discharge roller; and a second transmission mechanism for transmitting the driving force of said motor to said discharge roller in a second driving direction of said motor, said second transmission mechanism including a moving mechanism for moving transmission mechanism including a moving mechanism for moving said discharge roller to the second position when said motor is driven in the first driving direction and moving said discharge roller to the first position when said motor is driven in the second driving direction.

2. A recording apparatus comprising:

a platen roller for feeding a sheet to be subjected to a recording operation;

a motor for providing a driving force in two directions;

a first transmission mechanism having a one-way clutch for transmitting the driving force of said motor to said platen roller only in a first driving direction of said motor;

a discharge roller for discharging a recorded sheet, said discharge roller being movable between a first position in which the recorded sheet can be discharged by said discharge roller and a second position in which the recorded sheet cannot be discharged by said discharge roller;

a base plate for moving said discharge roller between the first position and the second position; and a second transmission mechanism for transmitting the driving force of said motor to said discharge roller in a second driving direction of said motor, said second transmission mechanism including frictional means for operating said base plate to move said discharge roller to the second position when said motor is driven in the first driving direction and to move said discharge roller to the first position when said motor is driven in the second driving direction.

3. A recording apparatus according to claim 2, wherein:

said second transmission mechanism has a first gear and a second gear engaged with said first gear; and said first gear is attached to said base plate and said second gear is attached to said discharge roller to that said second gear can revolve around the periphery of said first gear to move said base plate and cause said discharge roller to move between the first position and second position.

4. A recording apparatus according to claim 2, wherein said frictional means includes a friction plate and a spring dividing a friction force between said friction plate and said base so that movement of said base plate is determined by the relation between the friction force and the torque provided by said motor.

5. A recording apparatus comprising:

a platen roller for feeding a sheet to be subjected to a recording operation;

a motor for providing a driving force in two directions;

a first transmission mechanism including a one-way clutch for transmitting the driving force of said motor to said platen roller only in a first driving direction of said motor;

a first discharge roller for contacting a recorded sheet;

a second discharge roller for contacting a recorded sheet, said second discharge roller being movable between a first position in which said second discharge roller is urged against said first discharge roller so as to press the sheet therefrom for sheet discharge and a second position in which said second discharge roller is spaced from said first discharge roller;

a base plate for moving said second discharge roller between the first position and the second position; and a second transmission mechanism for transmitting the driving force of said motor to said second discharge roller in a second driving direction of said motor, said second transmission mechanism including frictional means for operating said base plate to move said second discharge roller to the second position when said motor is driven in the first driving direction and to move said second discharge roller to the first position when said motor is driven in the second driving direction.

* * * * *

UNITED STATES PATENT AND TRADEMARK OFFICE

CERTIFICATE OF CORRECTION

PATENT NO. : 4,884,909

DATED : December 5, 1989

INVENTOR(S) : YOSHITAKA WATANABE, ET AL.

It is certified that error appears in the above-identified patent and that said Letters Patent is hereby corrected as shown below:

COLUMN 3

Line 47, "is" should be deleted.

COLUMN 7

Line 6, "against," should read --against--.
Line 15, "sheets" should read --sheets P to be loaded can satisfactorily enter a gap between--.

COLUMN 9

Line 43, "by" should be deleted.

COLUMN 11

Line 17, "5" should be deleted.
Line 45, "executed" should read --executed.--.

COLUMN 14

Line 4, "separation levers 5" should read --separation levers 15--.
Line 31, "guides 17," should read --guides 17, and--.

COLUMN 15

Line 9, "is" (third occurrence) should be deleted.

UNITED STATES PATENT AND TRADEMARK OFFICE

CERTIFICATE OF CORRECTION

PATENT NO. : 4,884,909

DATED : December 5, 1989

INVENTOR(S) : YOSHITAKA WATANABE, ET AL.

It is certified that error appears in the above-identified patent and that said Letters Patent is hereby corrected as shown below:

COLUMN 18

Line 25, Close up right margin.
Line 26, Close up left margin.

COLUMN 21

Line 49, "roller 3" should read --roller 23--.
Line 61, "2," should read --42,--.

COLUMN 22

Line 61, "transmission mecha-" should be deleted.
Line 62, "nism including a moving mechanism for moving" should be deleted.

COLUMN 23

Line 32, "to" (second occurrence) should read --so--.

COLUMN 24

Line 2, "base" (first occurrence) should read --base plate--.

UNITED STATES PATENT AND TRADEMARK OFFICE

CERTIFICATE OF CORRECTION

PATENT NO. : 4,884,909

DATED : December 5, 1989

INVENTOR(S) : YOSHITAKA WATANABE, ET AL.

It is certified that error appears in the above-identified patent and that said Letters Patent is hereby corrected as shown below:

COLUMN 24

Line 20, "therefrom" should read --therebetween--

Signed and Sealed this

Fifteenth Day of December, 1992

*Attest:*

DOUGLAS B. COMER

*Attesting Officer*

*Acting Commissioner of Patents and Trademarks*